US007404918B1

(12) United States Patent
Hejna et al.

(10) Patent No.: US 7,404,918 B1
(45) Date of Patent: Jul. 29, 2008

(54) WOOD-BASED PRODUCT TREATED WITH SILICONE-CONTAINING MATERIAL AND DIANION, AND METHODS OF MAKING THE SAME

(75) Inventors: Donald J. Hejna, Bemidji, MN (US); Michael S. Urso, Spokane, WA (US)

(73) Assignee: Potlatch Corporation, Bemidji, MN (US)

( * ) Notice: Subject to any disclaimer, the term of this patent is extended or adjusted under 35 U.S.C. 154(b) by 627 days.

(21) Appl. No.: 10/900,079

(22) Filed: Jul. 26, 2004

Related U.S. Application Data

(60) Provisional application No. 60/490,197, filed on Jul. 25, 2003, provisional application No. 60/507,169, filed on Sep. 29, 2003.

(51) Int. Cl.
*B27N 3/00* (2006.01)

(52) U.S. Cl. ..... 264/109; 264/463

(58) Field of Classification Search ..... None
See application file for complete search history.

(56) References Cited

U.S. PATENT DOCUMENTS

| | | | | |
|---|---|---|---|---|
| 4,364,984 | A * | 12/1982 | Wentworth | 428/106 |
| 6,136,408 | A * | 10/2000 | Radcliffe et al. | 428/107 |
| 6,333,097 | B1 * | 12/2001 | Go et al. | 428/213 |
| 6,818,317 | B2 * | 11/2004 | Hejna et al. | 428/535 |
| 6,902,767 | B2 * | 6/2005 | Kelsoe | 427/387 |
| 2003/0175438 | A1 * | 9/2003 | Reeve | 427/387 |

* cited by examiner

*Primary Examiner*—Mary Lynn F Theisen
(74) *Attorney, Agent, or Firm*—Schwegman, Lundberg & Woessner, P.A.

(57) ABSTRACT

The present invention provides a product that includes (a) a wood-based product having a pair of outer surfaces; and (b) a silicone-containing material and a compound having a dianion each located on at least a portion of at least one outer surface, and the silicone-containing material at least partially penetrates at least a portion of at least one outer surface of the wood-based product. The invention also includes methods for manufacturing such product.

31 Claims, 9 Drawing Sheets

WOOD-BASED PRODUCT TREATED WITH SILICONE-CONTAINING MATERIAL AND DIANION, AND METHODS OF MAKING THE SAME

This application claims priority under 35 USC 119(e) to U.S. Provisional Application Nos. 60/490,197; filed Jul. 25, 2003; and 60/507,169; filed Sep. 29, 2003; which are incorporated herein by reference.

BACKGROUND OF THE INVENTION

Oriented Strand Board (OSB) is an engineered structural-use panel typically manufactured from thin wood strands bonded together with resin under heat and pressure, and it is used extensively for roof, wall, and floor sheathing in residential and commercial construction.

One drawback associated with known oriented strand boards (OSB) is that they are susceptible to decomposition by fungus. The problem is especially pronounced in the south eastern corridor of the United States (e.g., Florida and Louisiana). Several fungicides have been used in the pressure treatment of wood. The resulting pressure treated wood products may be temporarily resistant to fungus. However, many of these compounds are either extremely poisonous or are not suitable in the OSB manufacturing process.

Specifically, arsenic containing compounds, borates, and halogenated compounds (e.g., chromated copper arsenate (CCA), ammoniacal copper quat (ACQ), ammoniacal copper zinc arsenate (ACZA), creosote, and pentachlorophenol) have been used with limited success in the pressure treated wood industry. Arsenic is poisonous and its use has been criticized by several environmental groups.

The use of many known fungicides to produce oriented strand boards results in an oriented strand board with unacceptable physical properties. For example, many fungicides may undergo physical decomposition during the extreme conditions (e.g., temperature and pressure) typically experienced in the pressing stage (i.e., the step in which the resin is cured). As such, the resulting oriented strand board may not even be resistant to fungal infections.

The fungicide may not be chemically compatible with the resin. Moreover, the fungicide may lose its effectiveness over an extended period of time (e.g., about 25 years) and under normal weather conditions (e.g., rain, snow, heat, exposure to UV light, etc.). For example, the fungicide may leach out of the OSB over an extended period of time and under normal weather conditions.

Published PCT Application WO 03/062345 A2 discloses suitable antifungal formulations and methods of using these formulations to treat various substrates. This published PCT application, however, does not describe with sufficient detail, or provide any guidance on how to manufacture processed wood products (e.g., OSB or plywood) employing such antifungal formulations. Such processed wood products employ in the processes various substances (e.g., resins, waxes, etc.) as well as conditions (e.g., elevated temperatures and elevated pressures) that must be compatible with the antifungal formulations described therein to effectively provide a wood product that is antifungal.

As such, what is needed is a fungal resistant OSB; and processes for making the same. The fungal resistant OSB should include a fungicide that retains its effectiveness (i.e., antifungal properties) during the manufacturing of the OSB. The fungal resistant OSB should include an fungicide that retains its effectiveness over the extended periods of time typically encountered with the lifespan of the oriented strand board (e.g., up to about 25 years, up to about 50 years, or up to about 100 years).

During the manufacture and over the lifespan of the OSB, the fungicide should remain stable in the presence of the resin. The fungicide will preferably be inexpensive, easy to manufacture, convenient to use, environmentally safe, and/or chemically stable.

SUMMARY OF THE INVENTION

The present invention provides an antifungal wood-based product. The antifungal wood-based product includes (a) a wood-based product having at least a pair of oppositely facing outer surfaces; (b) an effective antifungal amount of a silicone-containing material present on at least a portion of at least one outer surface of the wood-based product, and the silicone-containing material at least partially penetrates at least a portion of at least one outer surface of the wood-based product; and (c) a compound having a dianion.

The present invention also provides an antifungal wood-based product prepared by the process that includes (i) contacting a wood-based product with an effective antifungal amount of a silicone containing material, such that the silicone-containing material is present on at least a portion of at least one outer surface of the wood-based product, and the silicone-containing material at least partially penetrates at least a portion of at least one outer surface of the wood-based product; and (ii) contacting at least a portion of at least one outer surface of the wood-based product with a compound having a dianion; such that portion of the surface of the wood-based product that contacts the dianion is the portion of the surface of the wood-based product that contacts the silicone containing material; wherein step (i) can be performed prior to step (ii), step (i) can be performed simultaneous with step (ii), or step (i) can be performed subsequent to step (ii).

The present invention also provides an antifungal wood-based product prepared by the process that includes (i) contacting flakes of wood with a first resin, such that the first resin is located on at least a portion of the surface of the flakes of wood; (ii) forming a blanket of substantially oriented flakes; and (iii) curing the first resin by exposing the first resin to at least one of an elevated temperature, an elevated pressure, and radiant energy; for a sufficient period of time; to effectively cure the first resin; thereby effectively providing a wood-based composite panel; (iv) contacting the wood-based composite panel with an effective antifungal amount of a silicone containing material, such that the silicone-containing material is present on at least a portion of at least one outer surface of the wood-based composite panel, and the silicone-containing material at least partially penetrates at least a portion of at least one outer surface of the wood-based composite panel; and (v) contacting at least a portion of at least one outer surface of the wood-based composite panel with a compound having a dianion; such that portion of the surface of the wood-based product that contacts the dianion is the portion of the surface of the wood-based product that contacts the silicone containing material; wherein step (iv) can be performed prior to step (v), step (iv) can be performed simultaneous with step (v), or step (iv) can be performed subsequent to step (v).

The present invention also provides an antifungal wood-based composite panel prepared by the process that includes (i) contacting veneers of wood with a first resin, such that the first resin is located on at least a portion of the surface of the veneers of wood; (ii) forming a stack of alternating oriented veneers; and (iii) curing the first resin by exposing the first resin to at least one of an elevated temperature, an elevated pressure, and radiant energy; for a sufficient period of time; to effectively cure the first resin; thereby effectively providing a wood-based composite panel; (iv) contacting the wood-based composite panel with an effective antifungal amount of a silicone containing material, such that the silicone-containing material is present on at least a portion of at least one outer surface of the wood-based composite panel, and the silicone-containing material at least partially penetrates at least a portion of at least one outer surface of the wood-based composite panel; and (v) contacting at least a portion of at least one outer surface of the wood-based composite panel with a compound having a dianion; such that portion of the surface of the wood-based product that contacts the dianion is the portion of the surface of the wood-based product that contacts the silicone containing material; wherein step (iv) can be performed prior to step (v), step (iv) can be performed simultaneous with step (v), or step (iv) can be performed subsequent to step (v).

The present invention also provides a process for manufacturing an antifungal wood-based product. The process includes (i) contacting the wood-based product with an effective antifungal amount of a silicone containing material, such that the silicone-containing material is present on at least a portion of at least one outer surface of the wood-based product, and the silicone-containing material at least partially penetrates at least a portion of at least one outer surface of the wood-based product; and (ii) contacting at least a portion of at least one outer surface of the wood-based product with a compound having a dianion; such that portion of the surface of the wood-based product that contacts the dianion is the portion of the surface of the wood-based product that contacts the silicone containing material; wherein step (i) can be performed prior to step (ii), step (i) can be performed simultaneous with step (ii), or step (i) can be performed subsequent to step (ii).

The present invention also provides a process for manufacturing an antifungal wood-based composite panel. The process includes (i) contacting flakes of wood with a first resin; (ii) orienting, in substantially alternate lengthwise and crosswise layers, the flakes of wood to provide a blanket of substantially oriented flakes; and (iii) curing the first resin by exposing the first resin to at least one of an elevated temperature, an elevated pressure, and radiant energy; for a sufficient period of time; to effectively cure the first resin; thereby effectively providing a wood-based composite panel; (iv) contacting the wood-based composite panel with an effective antifungal amount of a silicone containing material, such that the silicone-containing material is present on at least a portion of at least one outer surface of the wood-based composite panel, and the silicone-containing material at least partially penetrates at least a portion of at least one outer surface of the wood-based composite panel; and (v) contacting at least a portion of at least one outer surface of the wood-based composite panel with a compound having a dianion; such that portion of the surface of the wood-based product that contacts the dianion is the portion of the surface of the wood-based product that contacts the silicone containing material; wherein step (iv) can be performed prior to step (v), step (iv) can be performed simultaneous with step (v), or step (iv) can be performed subsequent to step (v).

The present invention also provides a process for manufacturing an antifungal wood-based composite panel. The process includes (i) contacting veneers of wood with a first resin; (ii) orienting, in alternating lengthwise and crosswise layers, the veneers of wood to provide a stack of alternating oriented veneers; (iii) curing the first resin by exposing the first resin to at least one of an elevated temperature, an elevated pressure, and radiant energy; for a sufficient period of time; to effectively cure the first resin; thereby effectively providing a wood-based composite panel; (iv) contacting the wood-based composite panel with an effective antifungal amount of a silicone containing material, such that the silicone-containing material is present on at least a portion of at least one outer surface of the wood-based composite panel, and the silicone-containing material at least partially penetrates at least a portion of at least one outer surface of the wood-based composite panel; and (v) contacting at least a portion of at least one outer surface of the wood-based composite panel with a compound having a dianion; such that portion of the surface of the wood-based product that contacts the dianion is the portion of the surface of the wood-based product that contacts the silicone containing material; wherein step (iv) can be performed prior to step (v), step (iv) can be performed simultaneous with step (v), or step (iv) can be performed subsequent to step (v).

The present invention also provides a process for manufacturing an antifungal wood-based composite panel. The process includes (i) contacting, in any suitable order, flakes of wood with a first resin, an effective antifungal amount of a silicone containing material, and a compound having a dianion; (ii) orienting, in substantially alternate lengthwise and crosswise layers, the flakes of wood to provide a blanket of substantially oriented flakes; and (iii) curing the first resin by exposing the first resin to at least one of an elevated temperature, an elevated pressure, and radiant energy; for a sufficient period of time; to effectively cure the first resin.

The present invention also provides a process for manufacturing an antifungal wood-based composite panel. The process includes (i) contacting, in any suitable order, veneers of wood with a first resin, an effective antifungal amount of a silicone containing material, and a compound having a dianion; (ii) orienting, in alternating lengthwise and crosswise layers, the veneers of wood to provide a stack of alternating oriented veneers; (iii) curing the first resin by exposing the first resin to at least one of an elevated temperature, an elevated pressure, and radiant energy; for a sufficient period of time; to effectively cure the first resin.

The present invention also provides a process for manufacturing an antifungal wood-based composite panel. The process includes (i) contacting flakes of wood with a first resin; (ii) orienting, in substantially alternate lengthwise and crosswise layers, the flakes of wood to provide a blanket of substantially oriented flakes; (iii) contacting, in any suitable order, the blanket of substantially oriented flakes with an effective antifungal amount of a silicone containing material and a compound having a dianion; and (iv) curing the first resin by exposing the first resin to at least one of an elevated temperature, an elevated pressure, and radiant energy; for a sufficient period of time; to effectively cure the first resin.

The present invention also provides a process for manufacturing an antifungal wood-based composite panel. The process includes (i) contacting veneers of wood with a first resin; (ii) orienting, in alternating lengthwise and crosswise layers, the veneers of wood to provide a stack of alternating oriented veneers; (iii) contacting, in any suitable order, the stack of alternating oriented veneers with an effective antifungal amount of a silicone containing material and a compound having a dianion; and (iv) curing the first resin by exposing the first resin to at least one of an elevated temperature, an elevated pressure, and radiant energy; for a sufficient period of time; to effectively cure the first resin.

The present invention also provides a process for manufacturing an antifungal wood-based composite panel. The process includes (i) contacting flakes of wood with a first resin;

(ii) orienting, in substantially alternate lengthwise and crosswise layers, the flakes of wood to provide a blanket of substantially oriented flakes; (iii) curing the first resin by exposing the first resin to at least one of an elevated temperature, an elevated pressure, and radiant energy; for a sufficient period of time; to effectively cure the first resin and thereby providing a wood-based composite panel; and (iv) contacting, in any suitable order, the wood-based composite panel with an effective antifungal amount of a silicone containing material and a compound having a dianion.

The present invention also provides a process for manufacturing an antifungal wood-based composite panel. The process includes (i) contacting veneers of wood with a first resin; (ii) orienting, in alternating lengthwise and crosswise layers, the veneers of wood to provide a stack of alternating oriented veneers; (iii) curing the first resin by exposing the first resin to at least one of an elevated temperature, an elevated pressure, and radiant energy; for a sufficient period of time; to effectively cure the first resin and thereby providing a wood-based composite panel; and (iv) contacting, in any suitable order, the wood-based composite panel with an effective antifungal amount of a silicone containing material and a compound having a dianion.

BRIEF DESCRIPTION OF THE FIGURES

Embodiments of the invention may be best understood by referring to the following description and accompanying drawings which illustrate such embodiments. The numbering scheme for the Figures included herein are such that the leading number for a given reference number in a Figure is associated with the number of the Figure. For example, a treated wood-based product (1) can be located in FIG. 1. However, reference numbers are the same for those elements that are the same across different Figures. In the drawings.

DETAILED DESCRIPTION OF THE INVENTION

Figure 1:
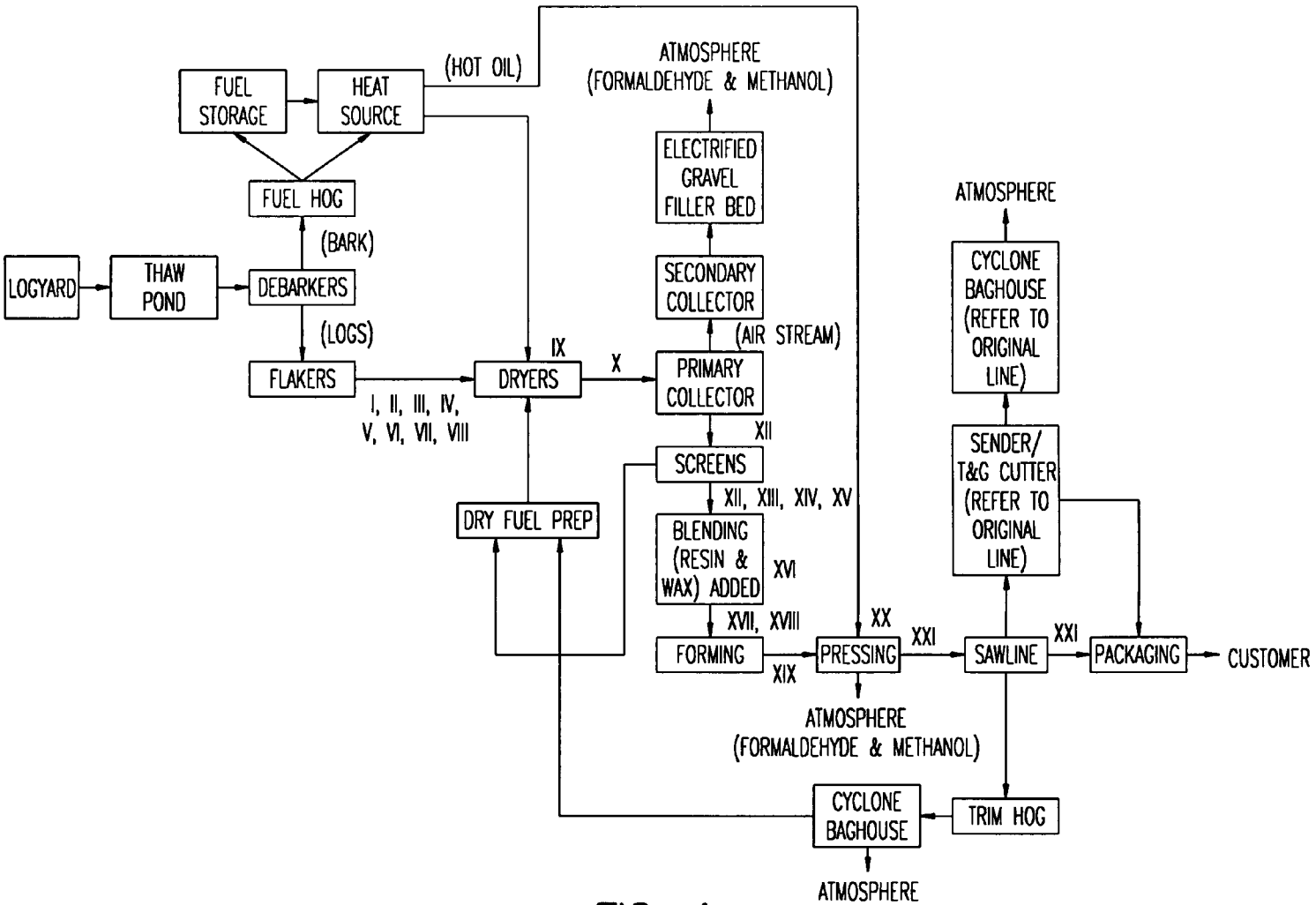
FIG. 1 illustrates a process flow of a treated panel of the present invention, wherein suitable locations and methods in which the resin and/or silicone-containing material antimicrobial can be introduced and applied (e.g., to the flakes) are shown in Roman numerals, which correspond to Tables I-II.

The present invention provides a treated wood-based product having an effective antifungal amount of a silicone-containing material present on at least a portion of at least one outer surface of the wood-based product, and the silicone-containing material at least partially penetrates at least a portion of at least one outer surface of the wood-based product; and a compound having a dianion present on at least a portion of at least one outer surface of the wood-based product, and the dianion optionally at least partially penetrates at least a portion of at least one outer surface of the wood-based product. The present invention also provides methods for manufacturing such treated wood-based products.

The treated wood-based product can be manufactured via a "hot press" or "in-line" method, or via a "cold press" or "off line" method. As such, each of the components of the treated wood-based product can withstand the manufacturing conditions of any pressing stage involved in the manufacturing process. The manufacturing conditions include time, temperature, and pressure. More specifically, the silicone-containing material can be contacted with the veneers or flakes prior to the pressing stage, thereby providing the treated wood-based product.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The present invention relates to a novel treated wood-based product, and to methods of making such treated wood-based products. When describing the treated wood-based product, and the methods of making the same, the following terms have the following meanings, unless otherwise indicated.

DEFINITIONS

As used herein, "adhered" refers to sticking together by or as if by grasping, suction or being glued. It includes joining, fastening, gluing, bonding, and fusing. The "adhering" can be accomplished by chemical means (e.g., adhesive or resin) by mechanical means (e.g., fastener), or a combination thereof.

As used herein, a "wood-based composite panel" or "panel" refers to a structural or non-structural product formed from a variety of materials including wood and/or wood substrate products (e.g., flakes or strands of wood, particles or particle strands of wood, fines or fines of wood, as well as veneers or veneers of wood). These materials are optionally formed from moisture-containing substrates, permeable substrates, and substrates which are both moisture-containing and permeable. Suitable wood-based composite panels include, e.g., particle board, oriented strand board (OSB), laminate veneer lumber (LVL), and plywood. The lifespan of the wood-based composite panel can be, e.g., up to about 25 years, up to about 50 years, or up to about 100 years. The panel can be configured, e.g., for tongue and groove fitting.

The wood-based composite panel will include a pair of oppositely facing outer surfaces that define the wood-based composite panel. As with any rectangular prism, the wood-based composite panel more precisely and accurately includes six outer surfaces (i.e., three pairs of oppositely facing surfaces). As such, as used herein a "pair of outer surfaces" or a "pair of oppositely facing outer surfaces" of the wood-based composite panel refers to the pair of outer surfaces or the pair of oppositely facing outer surfaces of the wood-based composite panel having the largest surface areas. It is appreciated that those of skill in the art understand that the wood-based composite panel includes six outer surfaces (i.e., three pairs of oppositely facing surfaces), but reference to the wood-based composite panel as including a pair of outer surfaces is acceptable and appropriate to those of skill in the art to refer to the pair of oppositely facing outer surfaces of the wood-based composite panel having the largest surface areas.

The wood-based composite panel can include any suitable number of plies. Specifically, the wood-based composite panel can include up to about 25 plies, up to about 20 plies, up to about 15 plies, or up to about 10 plies. Additionally, the plies can have any suitable thickness. Specifically, the plies can have a thickness of up to about two plies per ½ inch of total wood-based composite thickness, up to about five plies per ½ inch of total wood-based composite thickness, up to about seven plies per ½ inch of total wood-based composite thickness, or up to about ten plies per ½ inch of total wood-based composite thickness.

The treated wood-based product is fungal resistant and mold resistant. The treated wood-based product can optionally be fire retardant, moisture resistant, termite resistant, or a combination thereof. For example, the treated wood-based product can further include at least one of a fire retardant, moisture resistant substance, and a pesticide. Alternatively, the fungicide (i.e., silicone-containing material) can impart the requisite moisture resistance, fire retardant, and/or termite resistance to the treated wood-based product.

As used herein, "wood-based product" refers to wood-based composite products, as described herein, in addition to dimensional lumber, timber, paneling, structural paneling, decorative paneling, wainscoting, posts, poles, and millwork lumber.

As used herein, "oriented strand board" or "OSB" refers to an engineered structural-use panel typically manufactured from thin wood strands bonded together with resin under heat, pressure, and/or radiant energy. The strands are typically dried, blended with resin and wax (e.g., paraffinic wax, microcrystalline wax, and mixtures thereof), and formed into thick, loosely consolidated mats or blankets that are pressed under heat and pressure into large panels. The strands in the core layers are usually aligned substantially perpendicular to the strand alignment of the face layers, like the cross-laminated veneers of plywood.

It is appreciated that those of skill in the art understand that OSB is typically characterized by those starting materials or intermediate components (e.g., resin and flakes of wood) that are useful in making the OSB. While these materials may undergo a substantial conversion during the manufacturing of the OSB, reference to OSB as including these materials or components is acceptable and appropriate to those of skill in the art. For example, the flakes of wood and the resin, during the pressing step (e.g., curing), can undergo a chemical and/or physical conversion, such that they may no longer expressly and literally meet the criteria to be classified as flakes of wood and resin, respectively. Reference to the OSB as including a resin and flakes of wood is, however, acceptable and appropriate to those of skill in the art. As such, as used herein, "oriented strand board" includes resin(s) and flakes of wood.

Likewise, regarding dimensional lumber, timber, paneling, structural paneling, decorative paneling, wainscoting, posts, poles, and millwork lumber that is treated with a silicone-containing material and a dianion, reference to the above treated wood-based product(s) as containing a silicone-containing material and a dianion is suitable and appropriate to those of skill in the art. This is so even though during the manufacturing of the treated wood-based product(s), the silicone-containing material and/or the dianion can undergo a chemical and/or physical conversion.

Suitable OSB, and methods for making the same, are disclosed, e.g., in U.S. Pat. Nos. 6,333,097; 6,136,408; 6,098,679; 5,718,786; 5,525,394; 5,470,631; 5,443,894; 5,425,976; 5,379,027; and 4,364,984.

As used herein, a "flake" refers to a thin stand of wood that is produced from a flaker. In addition, as used herein, a "green flake" refers to a flake that has not been dried. The flake can have any suitable size, provided the flake can be effectively cured with a suitable resin. For example, the flake can typically have a length (y-dimension) of up to about 12 inches (30.4 cm), or about 4.5 inches (11.4 cm) to about 6.0 inches (15.2 cm); and can typically have a width x-dimension) of up to about 12 inches (30.4 cm), or about 1.5 inches (3.8 cm) to about 2.5 inches (6.4 cm). Likewise, the flake can typically have a thickness (z-dimension) of about 0.001 inches (0.0025 cm) to about 0.10 inches (0.254 cm), about 0.010 inches (0.0254 cm) to about 0.060 inches (0.1524 cm), or about 0.020 inches (0.0508 cm) to about 0.035 inches (0.089 cm). Typically, the width of the flake will be a function of the length of the flake. The length of the flake is typically at least about three times greater than the width of the flake, and typically no more than about ten times greater than the width of the flake. This allows for proper flake orientation and provides an OSB with acceptable physical properties.

As used herein, "blanket of flakes" refers to a plurality or mass of flakes having a discrete or continuous length, width, and height. The blanket of flakes can be formed, e.g., on a mat or a screen. A cross-sectional view of the blanket of flakes will typically illustrate that the flakes exist in multiple layers, thereby forming the blanket of flakes. The blanket of flakes can have a discrete length, width, and height. The blanket of flakes can typically have a width of up to about 16 feet, of up to about 12 feet, up to about 8 feet, or up to about 4 feet; a length of up to about 48 feet, of up to about 36 feet, or up to about 24 feet; and a thickness of up to about 2 feet, of up to about 1 foot, of up to about 8 inches, of up to about 6 inches, or of up to about 2 inches.

In another embodiment of the present invention, the blanket of flakes can have a discrete width, a discrete height, and a continuous length. In such an embodiment, the mat length or screen length can be greater than about 10 feet, greater than about 20 feet, or greater than about 40 feet. Such a mat or screen is typically referred to as a "continuous mat" or "continuous screen." The length of the blanket of flakes in such embodiment can typically be greater than about 10 feet, greater than about 20 feet, or greater than about 40 feet. In such an embodiment, the blanket of flakes can typically have a width of up to about 16 feet, up to about 12 feet, up to about 8 feet, or up to about 4 feet; and a thickness of up to about 2 feet, up to about 1 foot, up to about 8 inches, up to about 6 inches, or up to about 2 inches.

As used herein, "blanket of oriented flakes" refers to a blanket of flakes, as used herein, wherein each layer has flakes that are substantially perpendicular to the flakes in the layer directly below that specified layer (when present) and are substantially perpendicular to the flakes in the layer directly above that specified layer (when present).

As used herein, "plywood" refers to a laminate wood-based composite panel manufactured from thin wood veneers (i.e., laminates) bonded together with resin under heat and pressure. In one embodiment of the present invention, the plywood is manufactured from veneers of wood, wherein each veneer is perpendicular to the veneer directly above (if present) and directly below (if present) that veneer. In another embodiment of the present invention, each of the veneers face the same direction (e.g., in the lengthwise direction) to form what is referred to as laminate veneer lumber (LVL). In another embodiment, the veneers can be randomly oriented.

It is appreciated that those of skill in the art understand that plywood is typically characterized by those starting materials or intermediate components (e.g., resin and veneers of wood) useful in making the plywood. While these materials may undergo a substantial conversion during the manufacturing of the plywood, reference to the plywood as including these materials or components is acceptable and appropriate to those of skill in the art. For example, the veneers of wood and the resin, during the pressing step (e.g., curing), can undergo a chemical and/or physical conversion, such that they will no longer expressly meet the criteria to be classified as a veneer of wood and resin, respectively. Reference to the plywood as including a resin and veneers of wood, however, is acceptable and appropriate to those of skill in the art. As such, as used herein, "plywood" includes resin(s) and veneers of wood.

Suitable plywood, and methods for making the same, are disclosed, e.g., in Engineered Wood Products, A Guide for Specifiers, Designers and Users, Stephen Smulski, Ph. D, Editor in Chief, PFS Research Foundation, Madison, Wis. especially Chapter 2, Plywood by Michael McKAy; or Wood Handbook, Wood as an Engineered Material, reprinted from Forest Products Laboratory General Technical Report FPL-GTR-113 with consent of the USDA Forest Service, Forest Products Laboratory, especially Chapter 10-6, Wood Based Composites and Panel Products, Plywood. Specifically, the plywood can be any suitable plywood as manufactured by, e.g., Georgia-Pacific, Boise-Cascade, Nexfor Industries, Willamette, Roseburg Forest Products, Louisiana-Pacific, Weyerhaeuser, Hood Industries, Plum Creek, or Hunt Plywood Co.

As used herein, "particle board" refers to an engineered wood-based composite panel typically manufactured from wood particles bonded together with resin under heat, pressure, and/or radiant energy. The particles are typically dried, blended with resin and wax, and formed into thick, loosely consolidated mats or blankets that are pressed under heat and pressure into large panels.

A used herein, "wood particles" or "fines" refer to particles of wood having an average diameter of up to about 0.05 inches, up to 0.005 inches, or up to 0.0005 inches.

As used herein, "continuous press" refers to a method of manufacturing a wood-based composite panel wherein a press mat moves into the press in a continuous manner. Such a manner can be accomplished, e.g., by employing a series of rollers that push down upon the flakes, veneers, and/or wood particles. Those of skill in the art typically refer to a continuous press as having no mat length. It is appreciated that those of skill in the art understand that such reference is intended to refer to mats having a length, e.g., of more than about 20 feet.

As used herein, "off-line" refers to a method of manufacturing a treated wood-based composite panel that includes two steps; one step to manufacture the wood-based composite panel and another step to adhere the silicone-containing material to the wood-based composite panel. The off line process can include a "cold press" method of adhering the silicone-containing material to the wood-based composite panel.

As used herein, "on-line" or "in-line" refers to a method of manufacturing a treated wood-based composite panel that includes one step. The one step involves both manufacturing the wood-based composite panel and adhering the silicone-containing material to the wood-based composite panel. The on-line process can include a "hot press" method of adhering the silicone-containing material to the wood-based composite panel.

As used herein, "manufacturing conditions" refers to those conditions (e.g., time, temperature, and pressure) involved in any of the steps in the manufacturing of a treated wood-based product. Those steps include, for example, the pressing stage.

As used herein, "elevated temperature" refers to any temperature above room temperature, 77° F. (25° C.). Typically, the elevated temperature can be above about 100° C. (212° F.), above about 150° C. (302° F.), above about 200° C. (392° F.), or up to about 250° C. (482° F.). Specifically, the elevated temperature can be about 77° F. (25° C.) to about 315° C. (599° F.), about 100° C. (212° F.) to about 315° C. (599° F.), about 77° F. (25° C.) to about 218° C. (425° F.), about 100° C. (212° F.) to about 218° C. (425° F.), or about 175° C. (374° F.) to about 218° C. (425° F.).

Specifically, regarding oriented strand board (OSB) and methods for making the same, "elevated temperature" can be about 162° C. (325° F.) to about 246° C. (475° F.), about 177° C. (350° F.) to about 232° C. (450° F.), or about 191° C. (375° F.) to about 218° C. (425° F.). Specifically, regarding plywood and methods for making the same, "elevated temperature" can be about 107° C. (225° F.) to about 218° C. (425° F.), about 121° C. (250° F.) to about 204° C. (400° F.), or about 135° C. (275° F.) to about 191° C. (375° F.).

As used herein, "elevated pressure" refers to any pressure above standard pressure, 1 atm. (14.7 psi). Typically, the elevated pressure can be above about 5.0 atm (73.5 psi), above about 10.0 atm (146.9 psi), above about 20.0 atm (293.9 psi), above about 40.0 atm (587.8 psi), or above about 80.0 atm (1175.7 psi). Specifically, the elevated pressure can be about 60.0 atm. (881.8 psi) to about 85.0 atm (1249 psi).

Specifically, regarding oriented strand board (OSB) and methods for making the same, "elevated pressure" can be about 25 atm. (367 psi) to about 55 atm. (808 psi), about 30 atm. (441 psi) to about 50 atm. (735 psi), about 34 atm. (500 psi) to about 48 atm. (705 psi), or about 35 atm. (514 psi) to about 45 atm. (661 psi).

Specifically, regarding plywood and methods of making the same, "elevated pressure" can be about 8.0 atm. (118 psi) to about 21 atm (309 psi) or about 10.0 atm. (147 psi) to about 17 atm (250 psi).

"Substituted" is intended to indicate that one or more hydrogens on the atom indicated in the expression using "substituted" is replaced with a selection from the indicated group(s), provided that the indicated atom's normal valency is not exceeded, and that the substitution results in a stable compound. Suitable indicated groups include, e.g., alkyl, alkoxy, halo, haloalkyl, hydroxy, hydroxyalkyl, aryl, heteroaryl, heterocycle, cycloalkyl, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano. When a substituent is keto (i.e., =O) or thioxo (i.e., =S) group, then 2 hydrogens on the atom are replaced.

The term "alkyl" refers to a monoradical branched or unbranched saturated hydrocarbon chain preferably having from 1 to 40 carbon atoms, more preferably 1 to 10 carbon atoms, and even more preferably 1 to 6 carbon atoms. This term is exemplified by groups such as methyl, ethyl, n-propyl, iso-propyl, n-butyl, iso-butyl, sec-butyl, n-hexyl, n-decyl, tetradecyl, and the like.

The alkyl can optionally be substituted with one or more alkoxy, halo, haloalkyl, hydroxy, hydroxyalkyl, aryl, heteroaryl, heterocycle, cycloalkyl, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano.

The term "alkylene" refers to a diradical branched or unbranched saturated hydrocarbon chain preferably having from 1 to 40 carbon atoms, more preferably 1 to 10 carbon atoms, and even more preferably 1 to 6 carbon atoms. This term is exemplified by groups such as methylene, ethylene, n-propylene, iso-propylene, n-butylene, iso-butylene, sec-butylene, n-hexylene, n-decylene, tetradecylene, and the like.

The alkylene can optionally be substituted with one or more alkoxy, halo, haloalkyl, hydroxy, hydroxyalkyl, aryl, heteroaryl, heterocycle, cycloalkyl, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano.

The term "alkoxy" refers to the groups alkyl-O—, where alkyl is defined herein. Preferred alkoxy groups include, e.g., methoxy, ethoxy, n-propoxy, iso-propoxy, n-butoxy, tert-butoxy, sec-butoxy, n-pentoxy, n-hexoxy, 1,2-dimethylbutoxy, and the like.

The alkyoxy can optionally be substituted with one or more alkyl, halo, haloalkyl, hydroxy, hydroxyalkyl, aryl, heteroaryl, heterocycle, cycloalkyl, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano.

The term "aryl" refers to an unsaturated aromatic carbocyclic group of from 6 to 20 carbon atoms having a single ring (e.g., phenyl) or multiple condensed (fused) rings, wherein at least one ring is aromatic (e.g., naphthyl, dihydrophenanthrenyl, fluorenyl, or anthryl). Preferred aryls include phenyl, naphthyl and the like.

The aryl can optionally be substituted with one or more alkyl, alkoxy, halo, haloalkyl, hydroxy, hydroxyalkyl, heteroaryl, heterocycle, cycloalkyl, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano.

The term "cycloalkyl" refers to cyclic alkyl groups of from 3 to 20 carbon atoms having a single cyclic ring or multiple condensed rings. Such cycloalkyl groups include, by way of example, single ring structures such as cyclopropyl, cyclobutyl, cyclopentyl, cyclooctyl, and the like, or multiple ring structures such as adamantanyl, and the like.

The cycloalkyl can optionally be substituted with one or more alkyl, alkoxy, halo, haloalkyl, hydroxy, hydroxyalkyl, aryl, heteroaryl, heterocycle, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano.

The term "halo" refers to fluoro, chloro, bromo, and iodo. Similarly, the term "halogen" refers to fluorine, chlorine, bromine, and iodine.

"Haloalkyl" refers to alkyl as defined herein substituted by 1-4 halo groups as defined herein, which may be the same or different. Representative haloalkyl groups include, by way of example, trifluoromethyl, 3-fluorododecyl, 12,12,12-trifluorododecyl, 2-bromooctyl, 3-bromo-6-chloroheptyl, and the like.

The term "heteroaryl" is defined herein as a monocyclic, bicyclic, or tricyclic ring system containing one, two, or three aromatic rings and containing at least one nitrogen, oxygen, or sulfur atom in an aromatic ring, and which can be unsubstituted or substituted, for example, with one or more, and in particular one to three, substituents, like halo, alkyl, hydroxy, hydroxyalkyl, alkoxy, alkoxyalkyl, haloalkyl, nitro, amino, alkylamino, acylamino, alkylthio, alkylsulfinyl, and alkylsulfonyl. Examples of heteroaryl groups include, but are not limited to, 2H-pyrrolyl, 3H-indolyl, 4H-quinolizinyl, 4nH-carbazolyl, acridinyl, benzo[b]thienyl, benzothiazolyl, β-carbolinyl, carbazolyl, chromenyl, cinnaolinyl, dibenzo[b,d]furanyl, furazanyl, furyl, imidazolyl, imidizolyl, indazolyl, indolisinyl, indolyl, isobenzofuranyl, isoindolyl, isoquinolyl, isothiazolyl, isoxazolyl, naphthyridinyl, naptho[2,3-b], oxazolyl, perimidinyl, phenanthridinyl, phenanthrolinyl, phenarsazinyl, phenazinyl, phenothiazinyl, phenoxathiinyl, phenoxazinyl, phthalazinyl, pteridinyl, purinyl, pyranyl, pyrazinyl, pyrazolyl, pyridazinyl, pyridyl, pyrimidinyl, pyrimidinyl, pyrrolyl, quinazolinyl, quinolyl, quinoxalinyl, thiadiazolyl, thianthrenyl, thiazolyl, thienyl, triazolyl, and xanthenyl. In one embodiment the term "heteroaryl" denotes a monocyclic aromatic ring containing five or six ring atoms containing carbon and 1, 2, 3, or 4 heteroatoms independently selected from the group non-peroxide oxygen, sulfur, and N(Z) wherein Z is absent or is H, O, alkyl, phenyl or benzyl. In another embodiment heteroaryl denotes an ortho-fused bicyclic heterocycle of about eight to ten ring atoms derived therefrom, particularly a benz-derivative or one derived by fusing a propylene, or tetramethylene diradical thereto.

The heteroaryl can optionally be substituted with one or more alkyl, alkoxy, halo, haloalkyl, hydroxy, hydroxyalkyl, aryl, heterocycle, cycloalkyl, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano.

The term "heterocycle" refers to a saturated or partially unsaturated ring system, containing at least one heteroatom selected from the group oxygen, nitrogen, and sulfur, and optionally substituted with alkyl or $C(=O)OR^b$, wherein $R^b$ is hydrogen or alkyl. Typically heterocycle is a monocyclic, bicyclic, or tricyclic group containing one or more heteroatoms selected from the group oxygen, nitrogen, and sulfur. A heterocycle group also can contain an oxo group (=O) attached to the ring. Non-limiting examples of heterocycle groups include 1,3-dihydrobenzofuran, 1,3-dioxolane, 1,4-dioxane, 1,4-dithiane, 2H-pyran, 2-pyrazoline, 4H-pyran, chromanyl, imidazolidinyl, imidazolinyl, indolinyl, isochromanyl, isoindolinyl, morpholine, piperazinyl, piperidine, piperidyl, pyrazolidine, pyrazolidinyl, pyrazolinyl, pyrrolidine, pyrroline, quinuclidine, and thiomorpholine.

The heterocycle can optionally be substituted with one or more alkyl, alkoxy, halo, haloalkyl, hydroxy, hydroxyalkyl, aryl, heteroaryl, cycloalkyl, alkanoyl, alkoxycarbonyl, amino, alkylamino, acylamino, nitro, trifluoromethyl, trifluoromethoxy, carboxy, carboxyalkyl, keto, thioxo, alkylthio, alkylsulfinyl, alkylsulfonyl and cyano.

Examples of nitrogen heterocycles and heteroaryls include, but are not limited to, pyrrole, imidazole, pyrazole, pyridine, pyrazine, pyrimidine, pyridazine, indolizine, isoindole, indole, indazole, purine, quinolizine, isoquinoline, quinoline, phthalazine, naphthylpyridine, quinoxaline, quinazoline, cinnoline, pteridine, carbazole, carboline, phenanthridine, acridine, phenanthroline, isothiazole, phenazine, isoxazole, phenoxazine, phenothiazine, imidazolidine, imidazoline, piperidine, piperazine, indoline, morpholino, piperidinyl, tetrahydrofuranyl, and the like as well as N-alkoxy-nitrogen containing heterocycles.

Another class of heterocyclics is known as "crown compounds" which refers to a specific class of heterocyclic compounds having one or more repeating units of the formula $[—(CH_2—)_aA—]$ where a is equal to or greater than 2, and A at each separate occurrence can be O, N, S or P. Examples of crown compounds include, by way of example only, $[—(CH_2)_3—NH—]_3$, $[—((CH_2)_2—O)_4—((CH_2)_2—NH)_2]$ and the like. Typically such crown compounds can have from 4 to 10 heteroatoms and 8 to 40 carbon atoms.

The term "alkanoyl" refers to C(=O)R, wherein R is an alkyl group as previously defined.

The term "alkoxycarbonyl" refers to C(=O)OR, wherein R is an alkyl group as previously defined.

The term "amino" refers to $—NH_2$, and the term "alkylamino" refers to $—NR_2$, wherein at least one R is alkyl and the second R is alkyl or hydrogen. The term "acylamino" refers to RC(=O)N, wherein R is alkyl or aryl.

The term "nitro" refers to $—NO_2$.

The term "trifluoromethyl" refers to $—CF_3$.

The term "trifluoromethoxy" refers to $—OCF_3$.

The term "cyano" refers to —CN.

The term "hydroxy" refers to —OH.

As to any of the above groups, which contain one or more substituents, it is understood, of course, that such groups do not contain any substitution or substitution patterns which are sterically impractical and/or synthetically non-feasible. In addition, the compounds of this invention include all stereochemical isomers arising from the substitution of these compounds.

As used herein, "resin" refers to an adhesive polymer of either natural or synthetic origin. As used herein, a "polymer" is a compound formed by the reaction of simple molecules having functional groups that permit their combination to proceed to higher molecular weights under suitable conditions. Synthetic polymers are chemically designed and formulated into the adhesive to perform a variety of bonding functions.

As used herein, "outer surface" or "panel face" refers to the outermost boundary of a wood-based composite panel (e.g., OSB, LVL, or plywood). The outer surfaces of a wood-based composite panel include the top surface and the bottom surface. The wood-based composite panel will include a pair of oppositely facing outer surfaces that define the wood-based composite panel. As with any rectangular prism, the wood-based composite panel more precisely and accurately includes six outer surfaces (i.e., three pairs of oppositely facing surfaces). As such, as used herein a "pair of outer surfaces" or a "pair of oppositely facing outer surfaces" of the wood-based composite panel refers to the pair of outer surfaces or the pair of oppositely facing outer surfaces of the wood-based composite panel having the largest surface areas. It is appreciated that those of skill in the art understand that the wood-based composite panel includes six outer surfaces (i.e., three pairs of oppositely facing surfaces), but reference to the wood-based composite panel as including a pair of outer surfaces is acceptable and appropriate to those of skill in the art.

As used herein, "impregnate" refers to the filling, permeation, or saturation of a material (e.g., resin) into a substrate (e.g., flake, veneer, fine, OSB, LVL, or plywood).

As used herein, "completely impregnate" refers to about 100% impregnation of a material (e.g., resin) into a substrate (e.g., flake, veneer, fine, OSB, LVL, or plywood).

As used herein, "partially impregnate" refers to an impregnation of a material (e.g., resin or silicone-containing material) into a substrate (e.g., flake, veneer, fine, OSB, LVL, plywood, or wood-based product), of less than about 100%. The impregnation can be up to about 1/100 of the substrate, up to about 1/50 of the substrate, up to about 1/10 of the substrate, up to about 1/4 of the substrate, up to about 1/2 of the substrate, up to about 3/4 of the substrate, or up to about 99/100 of the substrate. More specifically, the impregnation can be about 1/20 to about 1/2 of the substrate.

As used herein, a "treated wood-based product" or "treated product" refers to a wood-based product, as described herein, that includes a silicone-containing material and a compound having a dianion, as described herein, on at least a portion of at least one of the outer surfaces of the wood-based product, and the silicone-containing material at least partially penetrates at least a portion of at least one outer surface of the wood-based product. Due to the presence of the silicone-containing material, the treated product can be considered a fungal resistant wood-based product.

As used herein, a "treated wood-based composite panel" or "treated panel" refers to a wood-based composite panel, as described herein, that includes a silicone-containing material and a compound having a dianion, as described herein, on at least a portion of at least one of the outer surfaces of the wood-based composite panel, and the silicone-containing material at least partially penetrates at least a portion of at least one outer surface of the wood-based composite panel. Due to the presence of the silicone-containing material, the treated panel can be considered a fungal resistant wood-based composite panel.

As used herein, a "fungal resistant wood-based product" or "fungal resistant product" refers to a wood-based product, as described herein, that is fungal resistant. The fungal resistant product possesses the ability to kill, destroy, inhibit, or inactivate a fungus thereby preventing growth more than had the treated product not include a fungicide. Specifically, the amount, if any, fungus present and growing on the surface will typically be less than about 25%, less than about 10%, less than about 5%, or less than about 1% of the fungus present and growing on the surface of an equivalent substrate that is non-fungal resistant and does not include a silicone-containing material.

The fungal resistant product will preferably meet the necessary requirements to be certified as a fungal resistant product. In doing so, the fungal resistant product, upon testing, will be approved by the relevant building codes and insurance rating bureaus typically known to those of skill in the art. The fungal resistant product, upon testing, will meet or exceed the requirements of a fungal resistant product, as promulgated by the relevant code sections for one or more of the following entities: Building Officials and Code Administrators International, Inc. (BOCA) National Building Code; Standard Building Code (SBC); Uniform Building Code (UBC); American Society for Testing Materials (ASTM); American Wood-Preservers' Association (AWPA); Underwriters Laboratories, Inc. (UL); U.S. Department of Defense (DOD); Military Specification (Mil); City of Los Angeles, Calif.; City of New York, N.Y. Building Code; International Conference of Building Officials (ICBO); and Southern Building Code Congress International, Inc. (SBCCI).

The fungal resistant product can either be surface treated or integrally treated. When surface treated, the wood, flakes or veneers present only on the outwardly facing surface(s) of the lumber, OSB or plywood are treated with the silicone-containing material. When integrally treated, up to 100% of the wood, flakes or veneers are treated with the silicone-containing material. Such wood, flakes or veneers may be present on both the outside and the inside of the lumber, OSB or plywood. As such, the silicone-containing material can be impregnated, completely impregnated, or partially impregnated into the substrate (e.g., lumber, flake, veneer, fine, OSB, LVL, or plywood), thereby providing a fungal resistant wood-based product.

In addition to the silicone-containing material, the treated product can optionally further include one or more fungicides or antifungal agents.

As used herein, a "fungicide" or "antifungal agent" refers to a chemical that will kill, destroy, inhibit, or inactivate a fungus to prevent growth. The chemical can be synthetic or biosynthetic and can include both organic and inorganic compounds. The fungicide can be a solid (e.g., powder), liquid, or a combination thereof. See, e.g., Concise Chemical and Technical Dictionary, Fourth Enlarged edition, Bennett, Chemical Publishing Company, NY, N.Y. (1986); and McGraw-Hill Concise Encyclopedia of Science & Technology, Fourth Edition, Parker, McGraw-Hill, NY, N.Y., (1998). Specifically, "fungicide" or "antifungal agent" can include a chemical that will kill, destroy, inhibit, or inactivate a eucaryotic microorganism to prevent growth. Exemplary eucaryotic microorganisms include algae, fungi, slime mold, protozoa, and eucaryotes in the microbial world.

Suitable fungicides include, e.g., formic acid, acetic acid, propionic acid, pelargonic acid, capric acid, copper ammonium acetate (CAA), copper naphthenate, and combinations thereof.

Suitable anti-mold agents include formic acid, acetic acid, propionic acid, pelargonic acid, capric acid, copper ammonium acetate (CAA), copper naphthenate, or a combination thereof.

The treated products can be configured, e.g., to have a surface variation of less than about 0.075 inches. Specifically, the treated products can be configured to have a surface variation of less than about 0.060 inches.

The treated wood-based composite can optionally include fines or fines of wood located near the outer surface(s) of the wood-based composite.

As used herein, "moisture vapor permeability" refers to the amount of moisture vapor that can pass through a specified amount of substance in a specified period of time, usually expressed in units of g/hr-m$^2$-mm Hg. Specifically, the treated product of the present invention can have a moisture vapor permeability of up to about 0.025 g/hr-m$^2$-mm Hg, or up to about 0.0005 g/hr-m$^2$-mm Hg. Alternatively, the treated product of the present invention can have a moisture vapor permeability of up to about 0.025 g/hr-m$^2$-mm Hg, or about 0.0005 g/hr-m$^2$-mm Hg.

As used herein, "fire retardant" refers to a substance that can exhibit an acceptable flame spread and smoke rating (e.g., about 30 or less, about 25 or less, about 20 or less, or about 15 or less). Additionally, it refers to a substance that can show little or no evidence of significant progressive combustion at a relatively long period of time (e.g., about 45 minutes or more, about 60 minutes or more, about 75 minutes or more, or about 90 minutes or more) of exposure to a flame. Suitable fire retardants include, e.g., phospho-ammonium boron compositions; 3,4,5,6-dibemzo-1,2-oxaphosphane-2-oxide or 9,10-dihydro-9-oxa-10-phospaphenanthrene-10-oxide (OPC); sulfamic acid monoammonium salt (ammonium sulfamate); di-n-butyltin oxide (DBTO); di-n-octyltin oxide (DOTO); dibutyltin diacetate di-n-butyltin diacetate (NS-8); dibutyltin dilaurate di-n-butyltin dilaurate (Stann BL); ferrocene; iron pentacarbonyl; ammonium sulfate; ammonium phosphate; zinc chloride; or a combination thereof.

As used herein, a "fire retardant treated wood-based product" or "fire retardant treated product" refers to a treated wood-based product, as described herein, that is fire retardant.

The fire retardant treated product will preferably meet the necessary requirements to be certified as a fire retardant product. In doing so, the fire retardant product, upon testing, will be approved by the relevant building codes and insurance rating bureaus typically known to those of skill in the art. The fire retardant treated product, upon testing, will meet or exceed the requirements of a fire retardant product, as promulgated by the relevant code sections for one or more of the following entities: Building Officials and Code Administrators International, Inc. (BOCA) National Building Code; Standard Building Code (SBC); Uniform Building Code (UBC); American Society for Testing Materials (ASTM); American Wood-Preservers' Association (AWPA); National Fire Protection Association (NFPA); Underwriters Laboratories, Inc. (UL); U.S. Department of Defense (DOD); Military Specification (Mil); City of Los Angeles, Calif.; City of New York, N.Y. Building Code; International Conference of Building Officials (ICBO); and Southern Building Code Congress International, Inc. (SBCCI).

Specifically, the fire retardant treated product can be certified by Underwriters Laboratories (UL); the fire retardant treated product can carry an "FRS" rating under UL classification, exhibiting acceptable flame spread and smoke rating (e.g., 25 or less); the fire retardant treated product can preferably show little or no evidence of significant progressive combustion at a relatively long period of time (e.g., 60 minutes or more) of exposure to flame; and/or the fire retardant treated product can be classified as a Type A fire retardant as defined in AWPA Standards.

Specifically, the fire retardant treated product can be classified as a wood-based product which, when impregnated with a fire retardant by a pressure process or other means during manufacturing, can have when treated in accordance with ASTM E84, Standard test Method or Surface Burning Characteristics of Building Materials, a flamespread index of 25 or less and can show no evidence of significant progressive combustion when the test is continued for an additional 20 minute period. In addition, the flame front should not progress more than 10.5 feet beyond the center line of the burner at any time during the test.

The fire retardant treated product can either be surface treated or integrally treated. When surface treated with the fire retardant, the wood, flakes or veneers present only on the outwardly facing surface(s) of the lumber, OSB or plywood are treated with a fire retardant. Alternatively, when integrally treated with the fire retardant, up to 100% of the wood, flakes or veneers are treated with a fire retardant. Such wood, flakes or veneers may be present on both the outside and the inside of the lumber, OSB or plywood. As such, the fire retardant can be impregnated, completely impregnated, or partially impregnated into the substrate (e.g., wood, flake, veneer, fine, OSB, LVL, or plywood), thereby providing a fire retardant treated product.

As used herein, "fungi" or "fungus" refers to a large and diverse group of eucaryotic microorganisms whose cells contain a nucleus, vacuoles, and mitochondria. Fungi include algae, molds, yeasts, mushrooms, and slime molds. See, Biology of Microorganisms, T. Brock and M. Madigan, 6th Ed., 1991, Prentice Hill (Englewood Cliffs, N.J.). Exemplary fungi include Ascomycetes (e.g., *Neurospora, Saccharomyces, Morchella*), Basidiomycetes (e.g., *Amanita, Agaricus*), Zygomycetes (e.g., *Mucor, Rhizopus*), Oomycetes (e.g., *Allomyces*), and Deuteromycetes (e.g., *Penicillium, Aspergillus*).

As used herein, "algae" refers to a large and diverse assemblage of eucaryotic organisms that contain chlorophyll and carry out oxygenic photosynthesis. See, Biology of Microorganisms, T. Brock and M. Madigan, 6th Ed., 1991, Prentice Hill (Englewood Cliffs, N.J.). Exemplary algae include Green Algae (e.g., *Chlamydomonas*), Euglenids (e.g., *Euglena*), Golden Brown Algae (e.g., *Navicula*), Brown Algae (e.g., *Laminaria*), Dinoflagellates (e.g., *Gonyaulax*), and Red Algae (e.g., *polisiphonia*).

As used herein, "mold" refers to a filamentous fungus, generally a circular colony that may be cottony, wooly, etc. or glabrous, but with filaments not organized into large fruiting bodies, such as mushrooms. See, e.g., Stedman's Medical Dictionary, 25th Ed., Williams & Wilkins, 1990 (Baltimore, Md.). One exemplary mold is the Basidiomycetes called wood-rotting fungi. Two types of wood-rotting fungi are the white rot and the brown rot. An ecological activity of many fungi, especially members of the Basidiomycetes is the decomposition of wood, paper, cloth, and other products derived from natural sources. Basidiomycetes that attack these products are able to utilize cellulose or lignin as carbon and energy sources. Lignin is a complex polymer in which the building blocks are phenolic compounds. It is an important constituent of woody plants. The decomposition of lignin in nature occurs almost exclusively through the agency of these wood-rotting fungi. Brown rot attacks and decomposes the cellulose and the lignin is left unchanged. White rot attacks and decomposes both cellulose and lignin. See, Biology of Microorganisms, T. Brock and M. Madigan, 6th Ed., 1991, Prentice Hill (Englewood Cliffs, N.J.).

As used herein, "yeast" refers to unicellular fungi, most of which are classified with the Ascomytes. See, Biology of Microorganisms, T. Brock and M. Madigan, 6th Ed., 1991, Prentice Hill (Englewood Cliffs, N.J.).

As used herein, "mushrooms" refer to filamentous fungi that are typically from large structures called fruiting bodies, the edible part of the mushroom. See, Biology of Microorganisms, T. Brock and M. Madigan, 6th Ed., 1991, Prentice Hill (Englewood Cliffs, N.J.).

As used herein, "slime molds" refers to nonphototrophic eucaryotic microorganisms that have some similarity to both fungi and protozoa. The slime molds can be divided into two groups, the cellular slime molds, whose vegetative forms are composed of single amoebalike cells, and the acellular slime molds, whose vegetive forms are naked masses of protoplasms of indefinite size and shape called plasmodia. Slime molds live primarily on decaying plant matter, such as wood, paper, and cloth. See, Biology of Microorganisms, T. Brock and M. Madigan, 6th Ed., 1991, Prentice Hill (Englewood Cliffs, N.J.).

As used herein, "fungal resistant" refers to a substrate (e.g., treated wood-based composite product) that has no appreciable amount of fungus present or growing on the surface therein. The amount, if any, fungus present or growing on the surface will typically be less than about 25%, less than about 10%, less than about 5%, or less than about 1% of the fungus present or growing on the surface of an equivalent substrate that is non-fungal resistant. The fungal resistant substrate will typically include a chemical that will kill, destroy, inhibit, or inactivate a eucaryotic microorganism to prevent growth. Exemplary eucaryotic microorganisms include algae, fungi, slime mold, protozoa, and eucaryotes in the microbial world. The substrate (e.g., treated wood-based product) can be fungal resistant due to the presence of one or more fungicides present on and/or in the substrate.

As used herein, "termite resistant" refers to a substrate (e.g., treated product) that has no appreciable amount of termites that eat a portion of the substrate. The amount, if any, termites that eat a portion of the substrate will typically be less than about 25%, less than about 10%, less than about 5%, or less than about 1% of the termites that would eat a portion of an equivalent substrate that is non-termite resistant. "Termite resistant" also refers to a substrate having the ability to prevent, mitigate, or lessen the likelihood of termites from eating, consuming or otherwise degrading a substrate more so than had the substrate not include a pesticide.

As used herein, a "termite resistant treated wood-based product" or "termite resistant treated product" refers to a treated wood-based product, as described herein, that is termite resistant. The termite resistant treated product will preferably meet the necessary requirements to be certified as a termite resistant wood-based product. In doing so, the termite resistant treated product, upon testing, will be approved by the relevant building codes and insurance rating bureaus typically known to those of skill in the art. The termite resistant treated product, upon testing, will meet or exceed the requirements of a termite resistant product, as promulgated by the relevant code sections for one or more of the following entities: Building Officials and Code Administrators International, Inc. (BOCA) National Building Code; Standard Building Code (SBC); Uniform Building Code (UBC); American Society for Testing Materials. (ASTM); American Wood-Preservers' Association (AWPA); Underwriters Laboratories, Inc. (UL); U.S. Department of Defense (DOD); Military Specification (Mil); City of Los Angeles, Calif.; City of New York, N.Y. Building Code; International Conference of Building Officials (ICBO); and Southern Building Code Congress International, Inc. (SBCCI).

As used herein, a "pesticide" refers to a chemical that is used as an insecticide, fungicide, acaricide (miticide), herbicide, rodenticide, bactericide, parasiticide, nematicide, and others used against pests. The chemical is used for the mitigation, control, or elimination of animals or plants detrimental to human health or economy. The chemical can be synthetic or biosynthetic and can include both organic and inorganic compounds. The pesticide can be a solid (e.g., powder), liquid, or a combination thereof. See, e.g., Concise Chemical and Technical Dictionary, Fourth Enlarged edition, Bennett, Chemical Publishing Company, NY, N.Y. (1986); and McGraw-Hill Concise Encyclopedia of Science & Technology, Fourth Edition, Parker, McGraw-Hill, NY, N.Y., (1998). "Pesticide" also refers to a substance, that when added to a treated wood-based product, will diminish the likelihood of a termite from eating a portion of the treated wood-based product, over the extended periods of time typically encountered with the lifespan of the wood-based product (e.g., up to about 25 years, up to about 50 years, or up to about 100 years).

One suitable pesticide useful in the present invention includes copper ammonium carbonate (CAC).

As used herein, "moisture resistant" refers to a substance that has a relatively low water permeability. Moisture resistant substances will have a relatively low amount of water that can pass through a specified amount of the substance in a specified period of time, usually expressed in units of g/hr-$m^2$-mm Hg. Specifically, the treated product of the present invention can have a water permeability of up to about 0.025 g/hr-$m^2$-mm Hg, or up to about 0.0005 g/hr-$m^2$-mm Hg. Alternatively, the treated product of the present invention can have a moisture vapor permeability of up to about 0.025 g/hr-$m^2$-mm Hg, or about 0.0005 g/hr-$m^2$-mm Hg.

The treated product will preferably meet the necessary requirements to be certified as a treated product. In doing so, the treated product, upon testing, will be approved by the relevant building codes and insurance rating bureaus typically known to those of skill in the art. The treated product, upon testing, will meet or exceed the requirements of a treated product, as promulgated by the relevant code sections for one or more of the following entities: Building Officials and Code Administrators International, Inc. (BOCA) National Building Code; Standard Building Code (SBC); Uniform Building Code (UBC); American Society for Testing Materials (ASTM); American Wood-Preservers' Association (AWPA);

Underwriters Laboratories, Inc. (UL); U.S. Department of Defense (DOD); Military Specification (Mil); City of Los Angeles, Calif.; City of New York, N.Y. Building Code; International Conference of Building Officials (ICBO); and Southern Building Code Congress International, Inc. (SBCCI).

Referring to FIGS. 1-10, a treated wood-based product (1) of the present invention, and methods of making the same, are provided. The treated wood-based product (1) includes a wood-based composite panel (2) having a pair of oppositely facing outer surfaces (e.g., a front side (8) and a back side (9)). The treated wood-based product (1) also includes a silicone-containing material (20) located on at least a portion of at least one outer surface of the wood-based composite panel (2) (e.g., the back side (9) of the wood-based composite panel (2) and/or the front side (8) of the wood-based composite panel (2)).

Optionally, each of a fire retardant (16), anti-fungal agent (17), pesticide (18), and an anti-mold agent (19) can be present on or in the treated wood-based product (1).

Treated OSB

A treated oriented strand board can be manufactured by contacting flakes (12) of wood with a first resin (5); orienting, in alternate lengthwise and crosswise layers, the flakes (12) of wood to provide a blanket of oriented flakes (12); curing the first resin (5) by exposing the first resin (5) to at least one of an elevated temperature, an elevated pressure, and radiant energy; for a sufficient period of time to effectively cure the first resin (5); and contacting a silicone-containing material (20) and a compound having a dianion (21) with at least a portion of at least one outer surface of the wood-based composite panel (2) (e.g., the back side (9) of the wood-based composite panel (2) and/or the front side (8) of the wood-based composite panel (2)).

Alternatively, a treated oriented strand board can be manufactured by contacting flakes (12) of wood with a first resin (5) and a silicone-containing material (20) and a compound having a dianion (21); orienting, in alternate lengthwise and crosswise layers, the flakes (12) of wood to provide a blanket of oriented flakes (12); and curing the first resin (5) by exposing the first resin (5) to at least one of an elevated temperature, an elevated pressure, and radiant energy; for a sufficient period of time to effectively cure the first resin (5).

Initially, logs pass through a flaker, where they are cut into thin strands (i.e., flakes (12)) of wood. Before the logs pass through a flaker, the logs can optionally be heated, especially if the logs are below about 10° C. (50° F.). The logs can be heated in any suitable manner, provided the physical and chemical integrity of the wood is not compromised. For example, the logs can be heated in a pond of water having a temperature of up to about 80° C. (176° F.), up to about 60° C. (140° F.), or up to about 40° C. (104° F.). Specifically, the logs can be heated in a pond of water having a temperature of about 100° F. (38° C.) to about 110° F. (43° C.). In addition, the logs can be heated for more than about 1 hour. Specifically, the logs can be heated for about 1 hour to about 48 hours. Alternatively, the logs can be heated via microwave for a suitable period of time, effective to dry the logs.

After the logs are cut into thin strands (i.e., flakes) of wood, the flakes (12) can optionally be dried to remove at least some of the water present therein. The flakes (12) can be dried in any suitable manner, provided at least some of the water present therein is removed. For example, the flakes (12) can be dried using a tumble dryer. The flakes (12) can be dried under any suitable conditions (e.g., at a temperature of above about 40° C. (104° F.) for about 10 seconds or more), provided at least some of the water present therein is removed. Specifically, the flakes (12) can be dried at about 180° F. to about 300° F. for about 8 minutes to about 10 minutes.

Upon exposure to the elevated temperature, elevated pressure, and/or radiant energy, the first resin (5) will cure, thereby adhering the flakes (12) of wood to one another.

Treated Plywood

A treated plywood can be manufactured by contacting veneers (13) of wood with a first resin (5); stacking the of veneers (13) of wood to form a stack of veneers (13); curing the first resin (5) by exposing the first resin (5) to at least one of an elevated temperature, an elevated pressure, and radiant energy; for a sufficient period of time to effectively cure the first resin (5), thereby forming a wood-based composite panel (2); and contacting a silicone-containing material (20) and compound having a dianion (21) with at least a portion of at least one outer surface of the wood-based composite panel (2) (e.g., the back side (9) of the plywood and/or the front side (8) of the plywood).

Upon exposure to the elevated temperature, elevated pressure, and/or radiant energy, the first resin (5) will cure, thereby adhering the veneers (13) of wood to one another.

Alternatively, a treated plywood can be manufactured by contacting veneers (13) of wood with a first resin (5), a silicone-containing material (20) and a compound having a dianion (21); stacking the of veneers (13) of wood to form a stack of veneers (13); and curing the first resin (5) by exposing the first resin (5) to at least one of an elevated temperature, an elevated pressure, and radiant energy; for a sufficient period of time to effectively cure the first resin (5).

Initially, the logs are debarked and then placed in a hot water vault for about 8 to about 24 hours. The logs are then placed in a lathe, where a spindle knife cuts the logs into veneers (13) of wood. The veneers (13) are clipped in pieces about 8 feet or less in width. The clipped pieces are manually sorted into face sheets, filler sheets, and core sheets. These green veneers (13) are optionally stored or directly placed into a dryer for a suitable period of time to remove at least some of the water present therein. The dried veneers (13) are either stored or used directly in the mill. The dried veneers (13) are contacted with a first resin (5) and then oriented in alternate lengthwise and crosswise layers on a sheet or screen to form a stack of oriented veneers (13) of wood. The stack of oriented veneers (13), having been contacted with the silicone-containing material (20) and the compound having a dianion (21), can be pressed (e.g., heated under pressure to compress the stack to a suitable thickness). Alternatively, the stack of oriented veneers (13) can be pressed (e.g., heated under pressure to compress the stack to a suitable thickness) and the silicone-containing material (20) and the compound having a dianion (21) can then be contacted with the plywood.

Specifically, the veneers (13) can be contacted with the silicone-containing material (20) and compound having a dianion (21) off line. More specifically, after to drying the veneers (13) and before curing the first resin (5), the veneers (13) can be contacted with the silicone-containing material (20) and compound having a dianion (21) off line. Alternatively, after curing the first resin (5), the veneers (13) can be contacted with the silicone-containing material (20) and compound having a dianion (21) off line.

A treated plywood can be manufactured by contacting veneers (13) of wood with a resin; stacking the of veneers (13) of wood to form a stack; and curing the resin by exposing the resin to at least one of an elevated temperature, an elevated pressure, and radiant energy; for a sufficient period of time to effectively cure the resin; wherein the face veneers (13) of wood are independently contacted with the silicone-containing material (20) and compound having a dianion (21) at any suitable step.

Species of Timber

Any suitable species of timber (i.e., wood) can be employed to make the treated wood-based composite product. In addition, the treated wood-based product can be manufactured from one or more suitable species of timber. Suitable types of timber include, e.g., Western, Northern (and Appalachian), and Southern timber.

Suitable Western timbers include, e.g., Incense-Cedar, Port-Orford-Cedar, Douglas Fir, White Fir, Western Hemlock, Western Larch, Lodgepole Pine, Ponderosa Pine, Sugar Pine, Western White Pine, Western Redcedar, Redwood, Engelmann Spruce, Sitka Spruce, Yellow-Cedar, Red Alder, Oregon Ash, Aspen, Black Cottonwood, California Black Oak, Oregon White Oak, Big Leaf Maple, Paper Birch, and Tanoak.

Suitable Northern (and Appalachian) timbers include, e.g., Northern White Cedar, Balsam Fir, Eastern Hemlock, Fraser Fir, Jack Pine, Red Pine, Eastern White Pine, Eastern Red Cedar, Eastern Spruce, Tamarack, Ash, Aspen, Basswood, Buckeye, Butternut, American Beech, Birch, Black Cherry, American Chestnut, Cottonwood, Elm, Hack Berry, True Hickory, Honey Locust, Black Locust, Hard maple, Soft Maple, Red Oak, White Oak, American Sycamore, Black Walnut, and Yellow-Poplar.

Suitable Southern timbers include, e.g., Atlantic White Cedar, Bald Cypress, Fraser Fir, Southern Pine, Eastern Red Cedar, Ash, Basswood, Arnecan, Beech, Butternut, Cottonwood, Elm, Hackberry, Pecan Hickory, True Hickory, Honey Locust, Black Locust, Magnolia, Soft Maple, Red Oaks, Sassafras, Sweetgum, American Sycamore, Tupelo, Black Walnut, Black Willow, and Yellow Poplar.

In one specific embodiment of the present invention, the flakes of wood or veneers of wood can be manufactured from at least one of Balsam fir (*Abies balsamea*), Red maple (*Acer rubrum*), Silver maple (*Acer saccharinum*), Sugar maple (*Acer saccharum*), Paper birch (*Betula papyrifera*), Yellow birch (*Betula alleghaniensis*), Black ash (*Fraxinus nigra*), Green ash (*Fraxinus pennsylvanica*), Tamarack (*Larix laricina*), Black spruce (*Picea mariana*), White spruce (*Picea glauca*), Eastern white pine (*Pinus strobes*), Jack pine (*Pinus banksiana*), Red pine (*Pinus resinosa*), Balsam poplar (*Populus balsamifera*), Bigtooth aspen (*Populus grandidentata*), Eastern Cottonwood (*Populus deltoids*), Quaking aspen (*Populus tremuloides*), and American basswood (*Tilia Americana*).

First Resins

As described herein, the flakes (12) or veneers (13) are contacted with a first resin (5). The flakes (12) or veneer are subsequently cured to mechanically and chemically bind the first resin (5) to the flakes (12) or veneers (13). Such curing can typically be accomplished by exposing the first resin (5) and flakes (12) or the first resin (5) and veneers (13) to elevated temperatures, elevated pressures, and/or radiant energy (e.g., UV, electron beam, microwave, beta radiation, gamma radiation, neutron beam, proton beam, infra red, etc.) for a sufficient period of time to effectively cure the first resin (5). The first resin (5) can optionally include a catalyst.

Upon curing, the first resin (5) can impregnate the flakes (12) or the veneers (13), or the first resin (5) can remain on the outer surface of the flakes (12) or the veneers (13). The curing provides an OSB or plywood wherein the first resin (5) is mechanically and chemically bound to the flakes (12) or the veneers (13). The chemical bonding results in the formation of chemical linkages between the first resin (5) and the cellulose and hemicellulose in the flakes (12) or the veneers (13). Such curing of the first resin (5), therefore, effectively provides for the underlying wood-based substrate.

The first resin (5) (i.e., adhesive polymer) can either be a thermoplastic polymer or a thermosetting polymer. Thermoplastic polymers are long-chain polymers that soften and flow on heating, then harden again by cooling. They generally have less resistance to heat, moisture, and long-term static loading than do thermosetting polymers. Common wood adhesives that are based on thermoplastic polymers include, e.g., polyvinyl acetate emulsions, elastomerics, contacts, and hot-melts. Alternatively, thermosetting polymers undergo irreversible chemical change, and on reheating, they do not soften and flow again. They form cross-linked polymers that have strength, have resistance to moisture and other chemicals, and are rigid enough to support high, long-term static loads without deforming. Suitable first resins (5) that are based on thermosetting polymers include, e.g., phenolic, resorcinolic, melamine, isocyanate, urea, an epoxy resin, a phenol-formaldehyde (PF) resin, a melamine-formaldehyde (MF) resin, a phenol-melamine-formaldehyde (PMF) resin, and combinations thereof.

The suitable first resin (5) can be of natural origin, can be of synthetic origin, or can include first resins (5) of a combination thereof. Suitable resins of natural origin include, e.g., animal protein, blood protein, casein protein, soybean protein, lignocellulostic residue and extracts, bark-based resins, and combinations thereof. Suitable resins of synthetic origin include, e.g., cross-linkable polyvinyl acetate emulsion, elastomeric contact, elastomeric mastic, emulsion polymer/isocyanate, epoxy, hot melt, isocyanate, formaldehyde, melamine and melamine urea, phenolic, polyvinyl acetate emulsion, polyurethane, resorcinol and phenol resorcinol, urea, and combinations thereof. In one embodiment of the present invention, the first resin (5) can be a foaming adhesive, such as dry cow blood.

Specifically, the first resin (5) can include an isocyanate resin, a melamine resin, a phenol-formaldehyde (PF) resin, a melamine-formaldehyde (MF) resin, a phenol-melamine-formaldehyde (PMF) resin, a melamine-urea-formaldehyde (MUF) resin, a phenol-melamine-urea-formaldehyde (PMUF) resin, or a combination thereof. More specifically, the first resin (5) can be a melamine resin, e.g., phenol-melamine-formaldehyde (PMF) resin which is commercially available from ARC Resins Corporation (Longueuil, Quebec, Canada), Borden Chemical Inc. (Columbus, Ohio), GP Resin (Atlanta, Ga.) or Dynea (Austria). PMF Resin is a phenol-melamine-formaldehyde copolymer.

Any suitable isocyanate can be employed as the first resin (5). Suitable isocyanates include, e.g., PMDI (polymethylenedipenyl-4,4'-diisocyanate); MDI (methylene diphenyl diisocyanate), or a combination thereof. Additional suitable isocayantes are disclosed, e.g., in Aldrich Catalogue (Milwaukee, Wis.).

The phenol can optionally be substituted. Suitable substituted phenols include, e.g., alkyl substituted phenols, aryl substituted phenols, cycloalkyl substituted phenols, alkenyl substituted phenols, alkoxy substituted phenols, aryloxy substituted phenols, and halogen substituted phenols, as disclosed in U.S. Pat. No. 5,700,587. Additional suitable substituted phenols are disclosed, e.g., in U.S. Pat. No. 6,132,549.

The formaldehyde can optionally be replaced with another suitable aldehyde. Suitable aldehydes include, e.g., formaldehyde, acetaldehyde, propionaldehyde, furfuraldehyde and benzaldehyde. In general, the aldehyde employed can have the formula R'CHO wherein R' is a hydrogen or a hydrocarbon radical of 1 to about 12 carbon atoms. Specifically, the aldehyde can be formaldehyde. Suitable additional aldehydes are disclosed, e.g., in U.S. Pat. No. 5,700,587 and Aldrich Catalogue (Milwaukee, Wis.).

The first resin (5) can be a solid (e.g., powder) or a liquid. When the first resin (5) is a liquid, the liquid resin can be relatively viscous or relatively non-viscous. When the first resin (5) is a liquid and is relatively viscous, the first resin (5) can optionally be diluted with one or more carriers to render the first resin (5) relatively non-viscous. Suitable carriers include, e.g., water, organic hydrocarbons, or a combination thereof.

Additional suitable first resins (5) can be found, e.g., in the *Handbook of Thermoset Plastics; Wood Handbook*, sections 9-16, 9-9, 10-3, and 10-4*; Forest Products Society Publications* (http://www.forestprod.org); *Wood Adhesives* 2000, extended abstracts cat. No. 7260*; International Contributions to Wood Adhesion Research*, cat. No. 7267*; Wood Adhesives* 1999, cat. No. 7296; 1998 *Resin Binding Seminar Proceedings*, cat. No. 7266*; Handbook of Pressure Sensitive Adhesive Technology,* 3rd Edition by Donatas Satas, Hardcover; *Handbook of Adhesive Technology*, by A. Pizzi, K. L. Mittal, Hardcover; *Resin Transfer Moulding*, by Kevin Potter, Hardcover; and *Cyanoacrylate Resins: The Instant Adhesives*, by Henry L. Lee, Paperback, T/C Press, January 1986; and references cited therein.

Additional suitable first resins (5) can be found, e.g., in U.S. Pat. Nos. 6,136,408; 6,132,549; 4,758,478; 5,700,587; 5,635,118; 5,714,099; 4,364,984; 4,407,999; 4,514,532; 5,425,908; 5,552,095; 5,554,429; 5,861,119; 5,951,795; 5,974,760; 6,028,133; 6,132,885; and references cite therein.

In one specific embodiment of the present invention, the first resin (5) can include a polyolefin (e.g., polyethylene, polypropylene, or a combination thereof), alone or in combination with poly vinylacetate (PVA).

Some suitable first resins (5) are commercially available from, e.g., Borden Chemical Inc. (Columbus, Ohio) and ARC Resins Corporation (Longueuil, Canada).

The first resin (5) can be cured, e.g., under a suitable pressure and temperature for a sufficient period of time effective to cure the first resin (5). The length of time will typically depend upon the desired thickness of the OSB or the plywood. The length of time can be up to about 1 minute, up to about 2 minutes, up to about 3 minutes, up to about 4 minutes, up to about 5 minutes, or up to about 10 minutes. Typically, the length of time can be about 3.5 minutes to about 7.5 minutes. For example, for ⅜ inch (9.52 mm) OSB, the length of time can be about 230 seconds to about 240 seconds, for 7/16 inch (11.11 mm) OSB, the length of time can be about 230 seconds to about 240 seconds, for 15/32 inch (11.9 mm) OSB, the length of time can be about 260 seconds to about 270 seconds, for ½ inch (12.7 mm) OSB, the length of time can be about 280 seconds to about 290 seconds, for ⅝ inch (15.88 mm) OSB, the length of time can be about 360 seconds to about 370 seconds, and for ¾ inch (19 mm) OSB, the length of time can be about 420 seconds to about 440 seconds.

The first resin (5), upon curing, will preferably impart water-resistance and weather resistance upon the OSB or the plywood. The first resin (5) typically employed, prior to curing, will typically not undergo chemical or physical decomposition, to any appreciable degree, such that the first resin (5) will not cure. Additionally, the first resin (5) typically employed, after curing, will remain stable throughout the subsequent OSB or plywood process step(s).

The first resin (5) may require the presence of a catalyst and/or accelerator to cure the first resin (5). Any suitable catalyst and/or accelerator can be employed, provided the first resin (5) effectively cures in a suitable period of time and the first resin (5), upon curing, remains chemically and physically stable. Suitable catalysts include acid catalysts (e.g., formic acid), base catalysts (e.g., sodium hydroxide, calcium hydroxide, potassium hydroxide, or soda ash), salt catalysts, peroxide catalysts, and sulfur compounds. Additionally, the first resin (5) can optionally include hardeners (e.g., amine hardeners added to epoxy and formaldehyde hardener added to resorcinol) to produce cross-linking reactions to solidify the first resin (5); antioxidants; acid scavengers; preservatives; wetting agents; defoamers; plasticizers; thickeners; and/or colorants. See, e.g., U.S. Pat. Nos. 6,132,549; 5,498,647; 5,700,587; 4,514,532; and 4,758,478.

The first resin (5), prior to or upon curing, can impregnate the flake or the veneer. Specifically, the first resin (5), prior to or upon curing, can completely impregnate the flake or the veneer (i.e., the resin is completely embedded in the flake or the veneer). Alternatively, the first resin (5), prior to or upon curing, can partially impregnate the flake or the veneer. Specifically, the first resin (5), prior to or upon curing, can impregnate up to about 1/100 of the flake, up to about 1/50 of the flake, up to about 1/10 of the flake or the veneer, up to about ¼ of the flake or the veneer, up to about ½ of the flake or the veneer, up to about ¾ of the flake or the veneer, or up to about 99/100 of the flake or the veneer. More specifically, the first resin (5), prior to or upon curing, can impregnate about 1/20 to about ½ of the flake or the veneer.

Step(s) in which First Resin can be Added to Flakes

Figure 2:
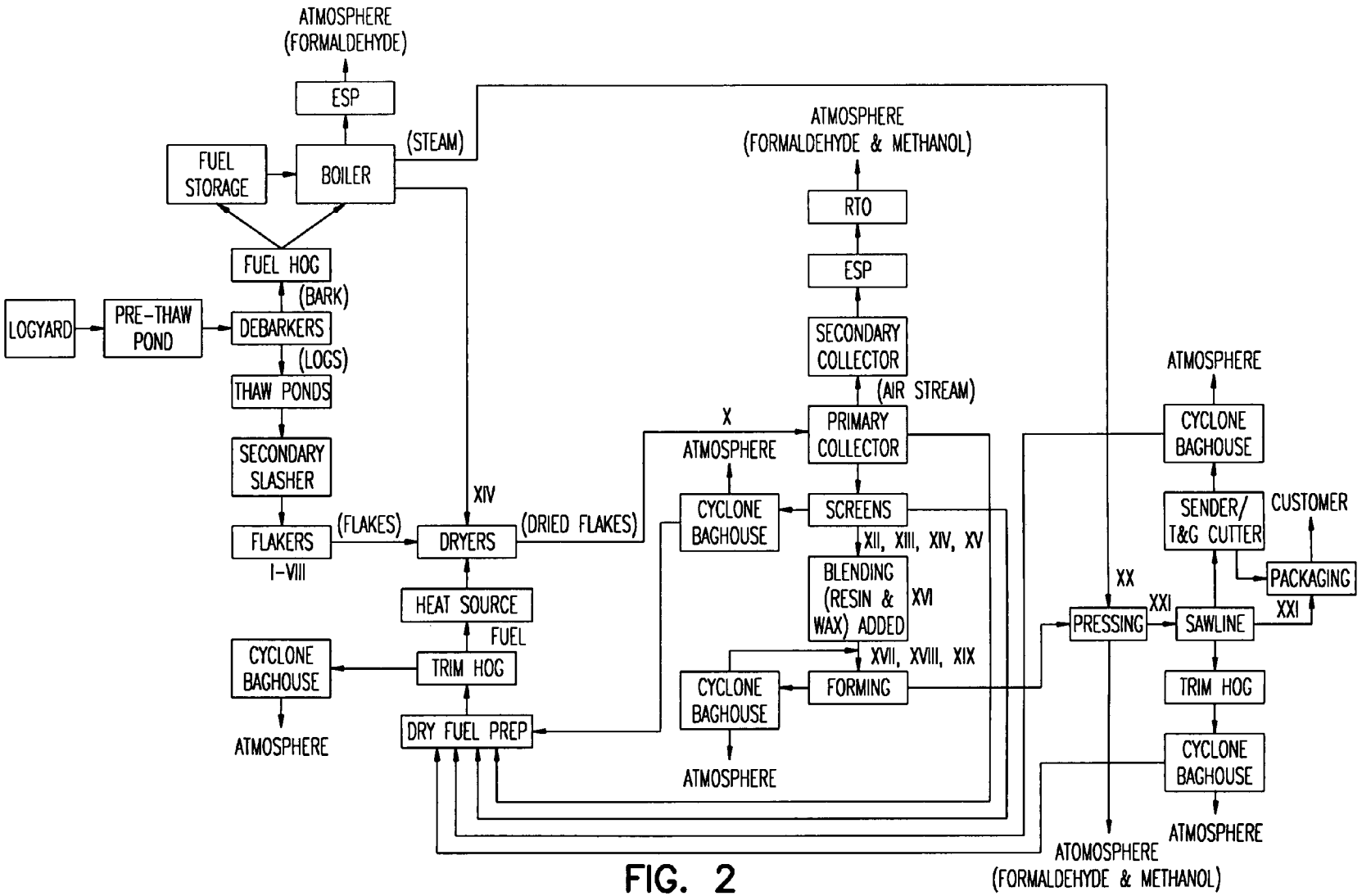
FIG. 2 illustrates a process flow of a treated panel of the present invention, wherein suitable locations and methods in which the resin and/or silicone-containing material antimicrobial can be introduced and applied (e.g., to the flakes) are shown in Roman numerals, which correspond to Tables I-II.
Figure 3:
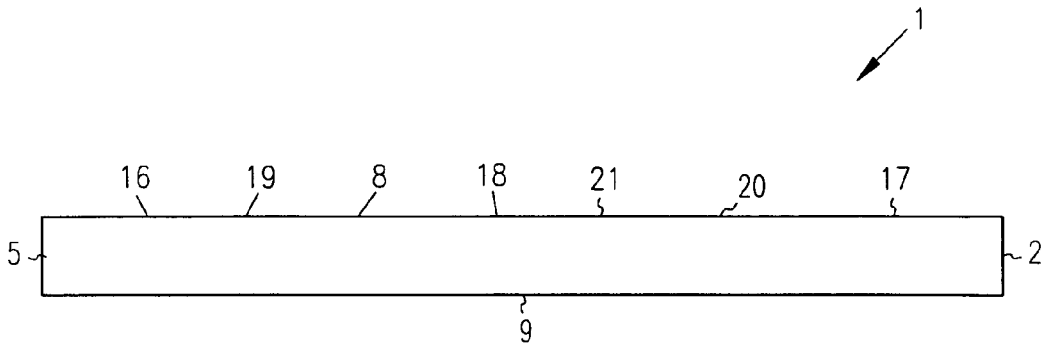
FIG. 3 illustrates a cross-sectional view of a treated panel of the present invention.
Figure 4:
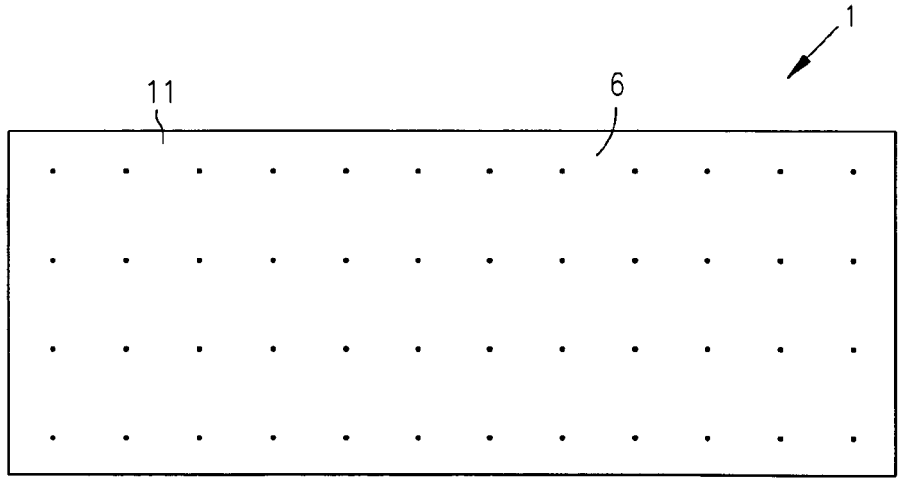
FIG. 4 illustrates a top view of a treated panel of the present invention.
Figure 5:
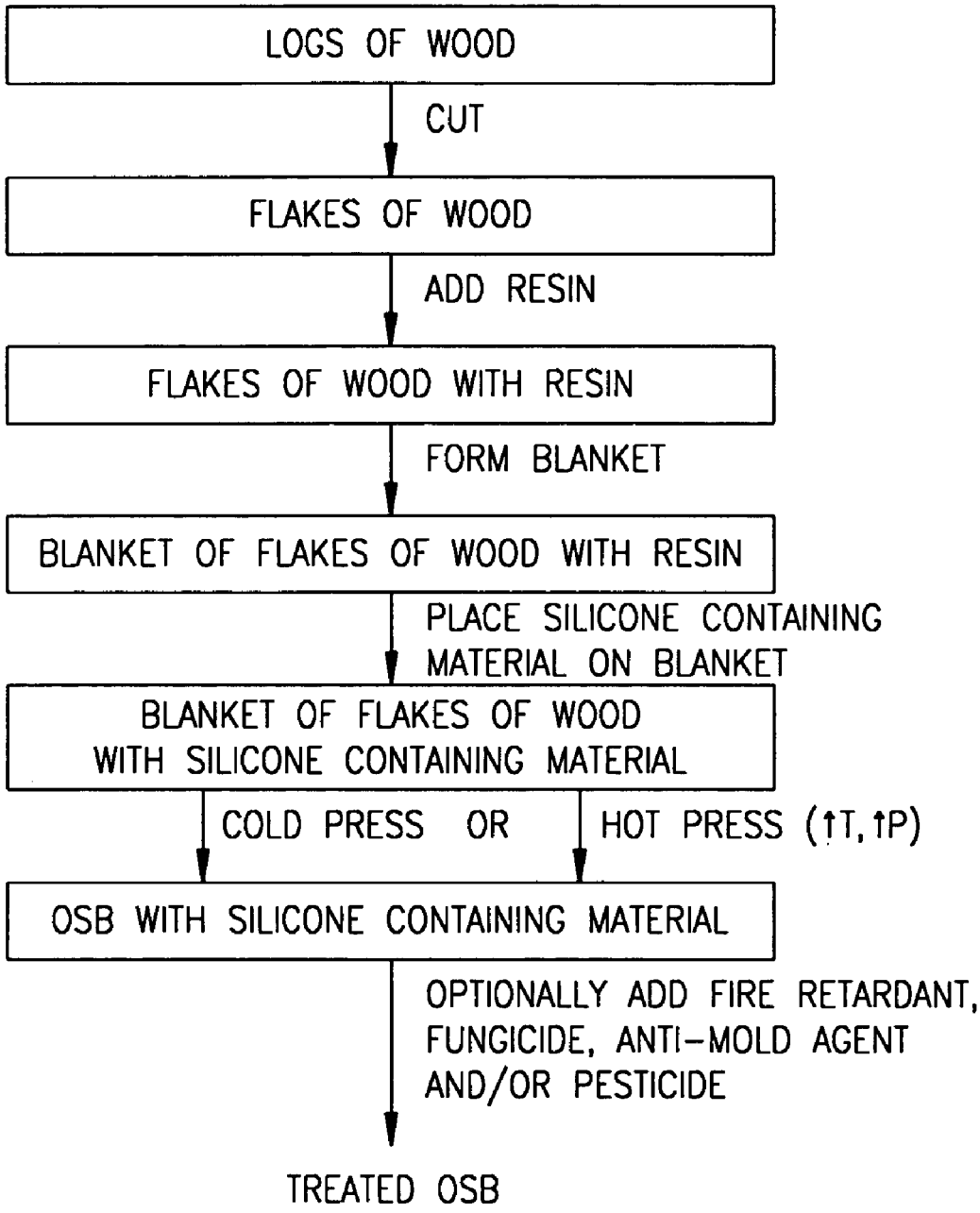
FIG. 5 illustrates process flow of a treated panel of the present invention.
Figure 6:
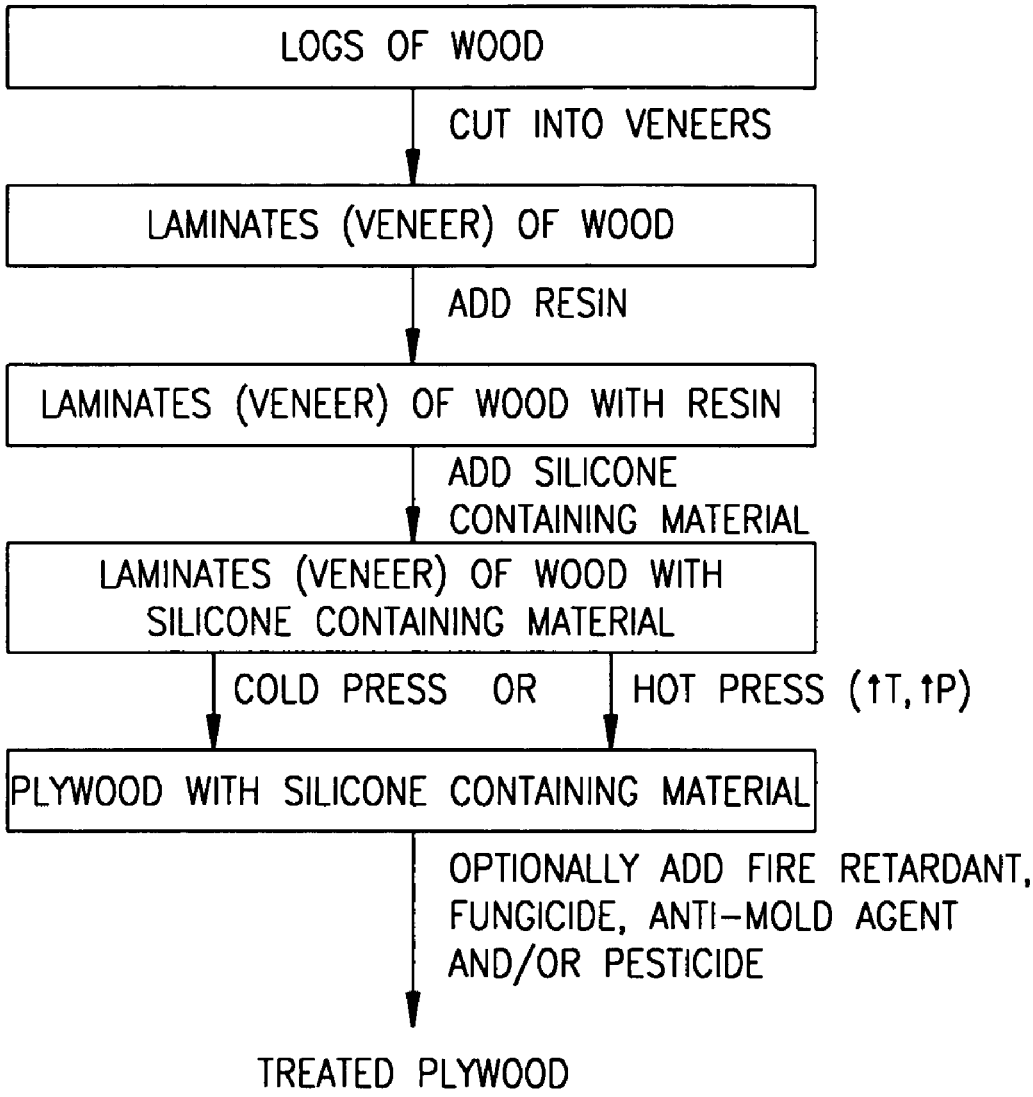
FIG. 6 illustrates a process flow of a treated panel of the present invention.
Figure 7:
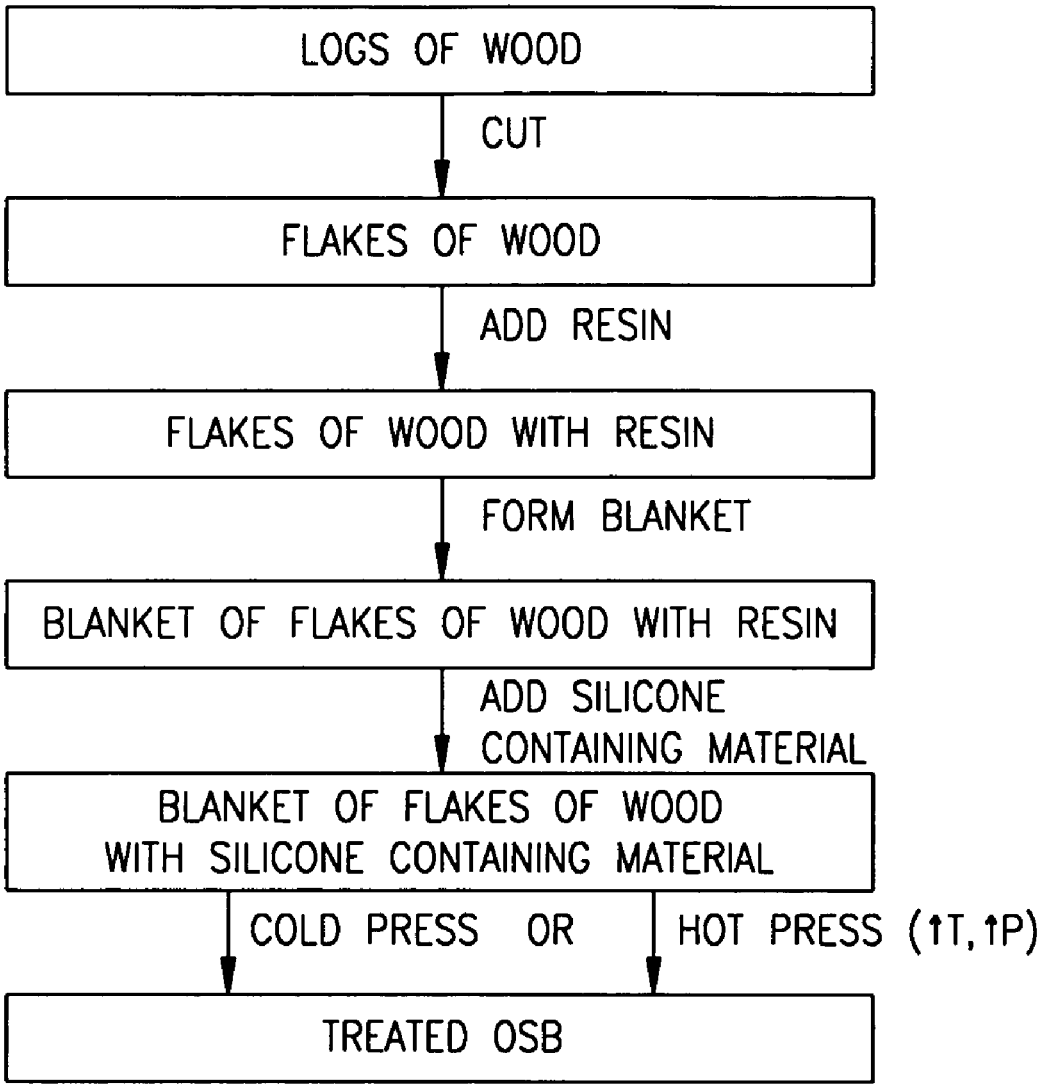
FIG. 7 illustrates process flow of a treated panel of the present invention.
Figure 8:
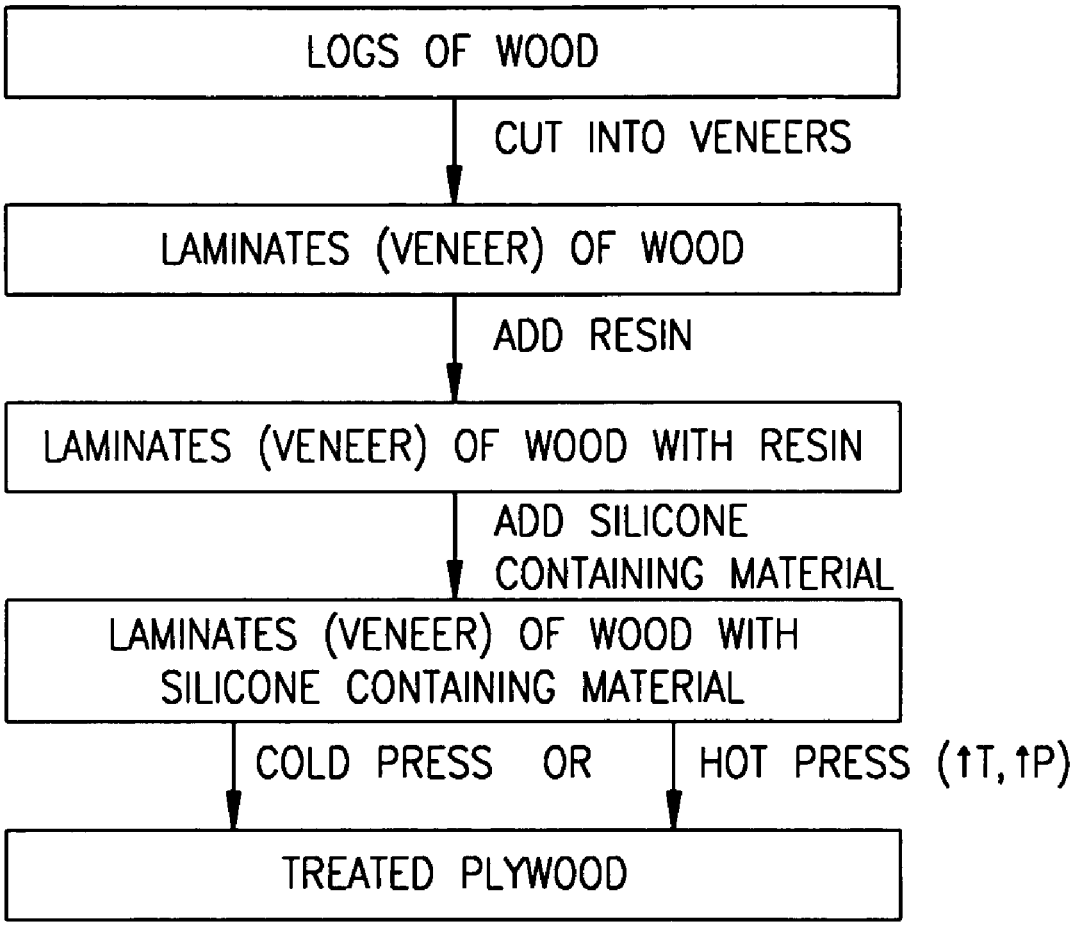
FIG. 8 illustrates a process flow of a treated panel of the present invention.
Figure 9:
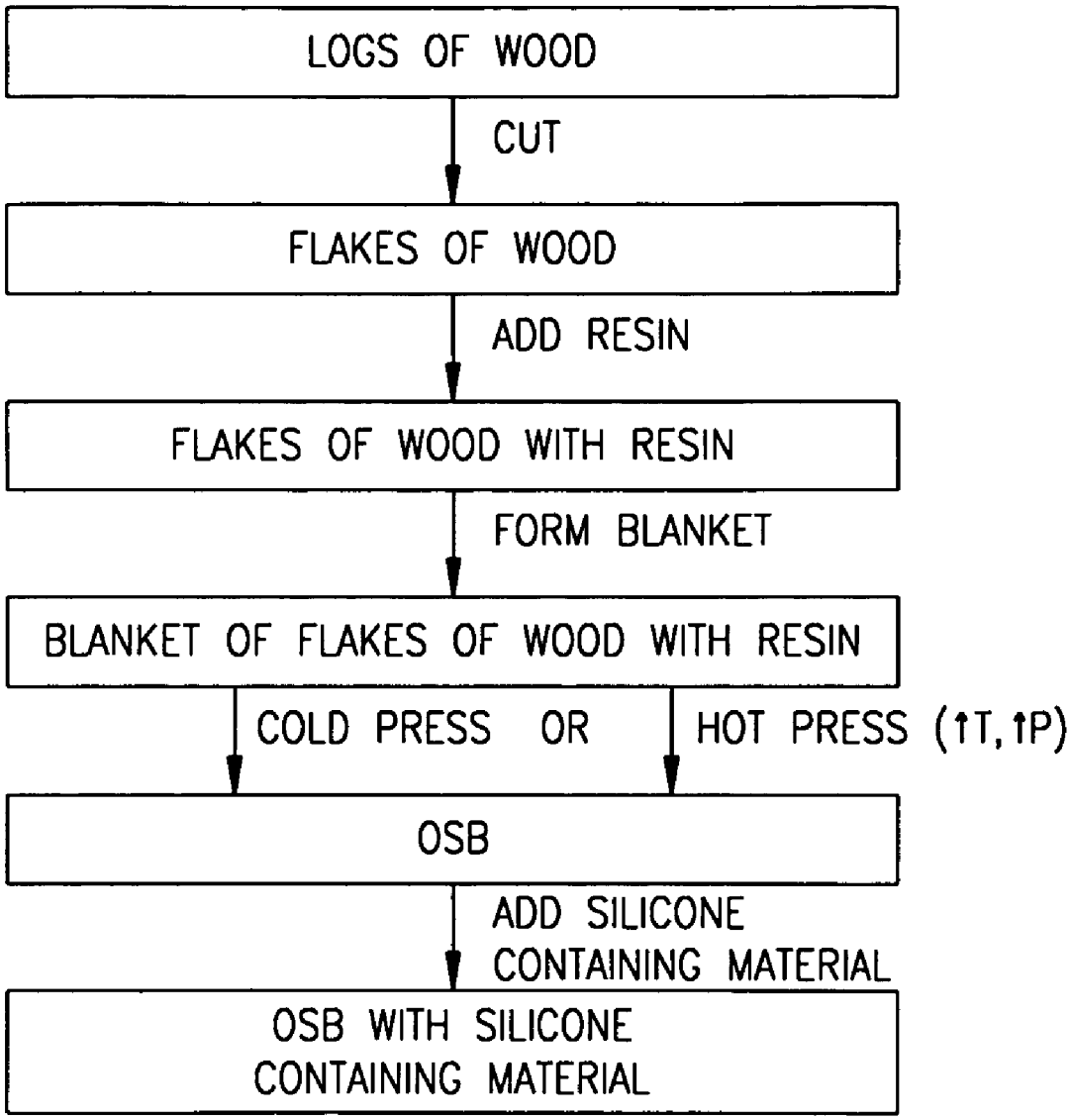
FIG. 9 illustrates process flow of a treated panel of the present invention.
Figure 10:
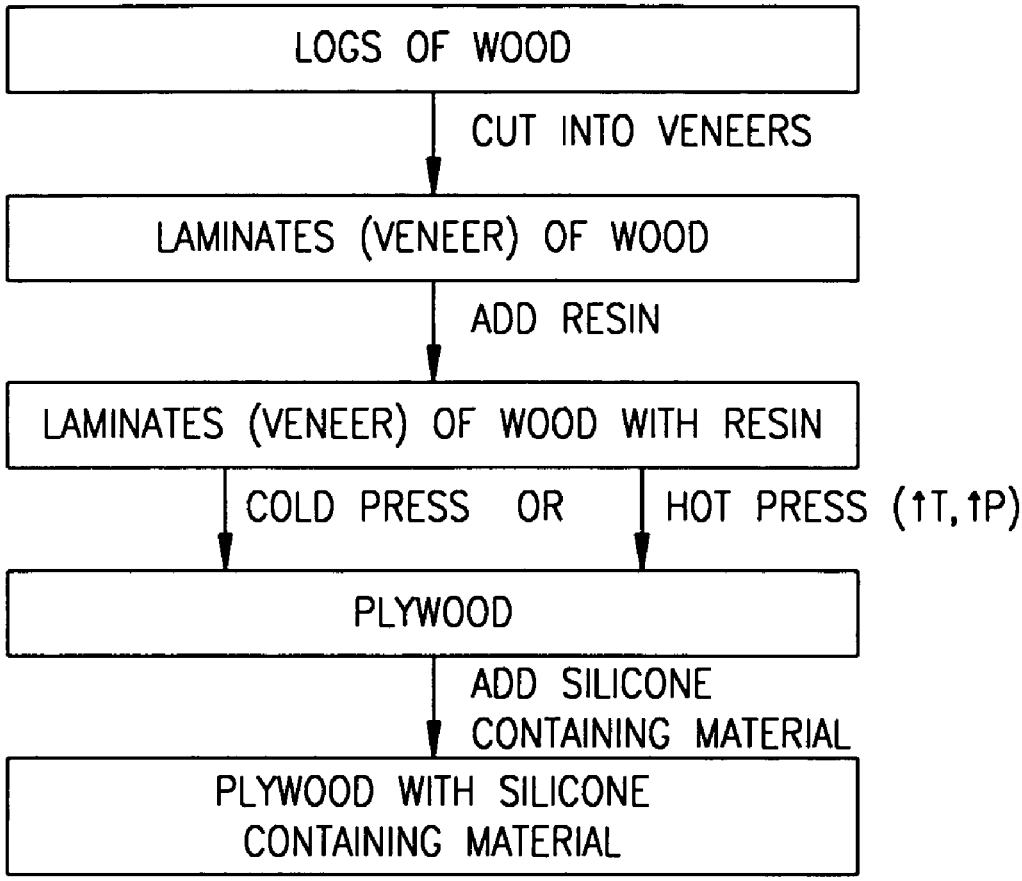
FIG. 10 illustrates process flow of a treated panel of the present invention.

As disclosed in Tables I and II and FIGS. 1-2, the flakes (12) of wood can be contacted with the first resin (5) at any suitable step to provide a treated oriented strand board (1), provided: the first resin (5) effectively cures during the pressing of the blanket of oriented flakes (12); and the resin retains its adhesiveness over the extended periods of time typically encountered with the lifespan of the treated oriented strand board (1). The lifespan can be, e.g., to about 10 years, up to about 25 years, up to about 50 years, or up to about 100 years).

Specifically, the flakes (12) of wood can be contacted with the first resin (5) after the flakes (12) of wood are dried and before the flakes (12) of wood are pressed.

Specifically, as disclosed in Tables I and II and FIGS. 1-2, the flakes (12) of wood can be contacted with the first resin (5) at a flaker outfeed, on a flake conveyor belt, at a drop-out to green bins (pantlegs), at an entry to green bins, on the inside of a green bins, at a green bin outfeed (drop chute), at a screw auger pan to dryer, at a airlock separation, at a dryer infeed, at a 1$^{st}$ pass of 3 pass dryer, at a dryer outfeed, at a primary cyclone, at an airlock separation, at a reversing conveyor to dry bin or fire dump or conveyor to screens, at an inside dry bins, at a dry bin conveyor, at a scales, on a conveyor, inside a blender, at a forming line heads, at a forming line, at a caul plate or screen, at a steam injection in press, or any combination thereof.

Specifically, as disclosed in Tables I and II and FIGS. 1-2, the flakes (12) of wood can be contacted with the first resin (5) inside the blender.

Method(s) to Apply the First Resin to Flakes

The first resin (5) can be applied to the flakes (12) in any suitable manner, provided: the first resin (5) effectively cures during the pressing of oriented flakes (12) (i.e., pressing stage); and the first resin (5) retains its adhesiveness over the extended periods of time typically encountered with the lifespan of the treated oriented strand board (1). The lifespan can be, e.g., up to about 25 years, up to about 50 years, or up to about 100 years.

Specifically, Tables I-II and FIGS. 1-2 illustrate suitable methods in which the flakes (12) can be contacted with the first resin (5). These suitable methods include, e.g., spraying, rolling, laminating, pressure injecting, dipping, and/or injecting the flakes (12) with the first resin (5). Specifically, the flakes (12) can be contacted with the first resin (5) by spraying the flakes (12) with the first resin (5).

Specifically, the flake of wood can be contacted with the first resin (5) by spraying the first resin (5) onto the flakes (12) of wood. More specifically, the flake of wood can be contacted with the first resin (5) by dry spraying the powdered first resin (5) onto the flakes (12) of wood.

The following table illustrates possible locations and methods in which the first resin (5) can be introduced and applied to the flakes (12) of wood, wherein the locations are shown in the accompanying figures herein below.

TABLE I

| Id. | Materials Handling Process-Generic | Application Location | Comments |
|---|---|---|---|
| I. | Flaker to Convey system | Flaker Outfeed | |
| II. | Convey to Green Bins | Flake Conveyor belt | |
| III. | Convey to Green Bins | Drop-out to Green Bins (Pantlegs) | |
| IV. | Convey to Green Bins | Entry to Green Bins | |
| V. | Green Bin | Inside Green Bins | Head end before doffing rolls |
| VI. | Green Bin to Dryer | Green Bin Outfeed (drop chute) | |
| VII. | Green Bin to Dryer | Screw auger pan to dryer | |
| | Airlock Separation | Airlock Separation | Flakes are clumped and compressed |
| VIII. | Convey to Dryer | Dryer infeed | |
| IX. | Inside Dryer | 1st Pass of 3 pass dryer | Could also be inside conveyor dryer |
| X. | Convey to Product Separator (Primary Cyclone) | Dryer Outfeed | Nozzles in dryer outfeed |
| XI. | Product Separator Airlock Separation | Primary Cyclone Airlock Separation | |
| XII. | Convey to Screens and Dry Bins | Reversing Conveyor to Dry Bin or Fire Dump or Conveyor to Screens | |
| XIII. | Dry Bin | Inside Dry Bins | Head end before doffing rolls |
| XIV. | Convey to scales Scales | Dry bin conveyor Scales | |
| XV. | Convey to Blender | On conveyor | Dry Chemical and/or Resin - Together or separately |
| XVI. | Blender | Inside Blender | Dry Chemical, Liquid Resin Liquid Chemical, Liquid Resin Dry Chemical, Dry Resin |

TABLE I-continued

| Id. | Materials Handling Process-Generic | Application Location | Comments |
|---|---|---|---|
| | | | Liquid Chemical, Dry Resin |
| XVII. | Forming Heads | Forming Line Heads | Applying in forming head bins |
| XVIII. | Forming | Forming Line | Spray on dry flake mat |

The following table illustrates additional possible locations and methods in which the first resin (5) can be introduced and applied to the flakes (12) of wood. The locations are shown in the accompanying figures herein below.

TABLE II

| Id. | Materials Handling Process-Generic | Application Location | Comments |
|---|---|---|---|
| XIX. | Convey | New Option: Pneumatic Conveyor | From Flaker to Green Bin - spray nozzles in pneumatic pipe |
| XX. | Green Flake Blender | Somewhere between 1 and 5, or at 6 and 7, or 8 | Could be off-line operation, or integrated into line |
| XXI. | Pre-dry (flake) Operation | After flaker, re-introduce to Green Bin or Dryer | Could be off-line operation or integrated into line |
| XXII. | Pre-Dry (flake) Operation | New Equip Options: Radio Frequency Microwave Rotary Dryer Conveyor Dryer Fluidized Bed Low Headspace Drying | |
| XXIII. | Pre-Dry or Dry | Conventional Line drying Options: Rotary Triple Pass Conveyor New Equipment: Single Pass Dryer Single Pass combination Blender/Dryer | |
| XXIV. | Pre-Compression | Pre-compression roller | |
| XXV. | Separate Operation | On Conventional OSB | Similar to conventional post-production treating Spray Spread Dip Pressure Treat (Retort) Pressure Inject Laminate |

Step(s) in which First Resin can be Added to Veneers

The veneers (13) of wood can be contacted with the first resin (5) at any suitable step to provide a treated plywood (1), provided: the first resin (5) effectively cures during the pressing of the stack of veneers (13); and the first resin (5) retains its adhesiveness over the extended periods of time typically encountered with the lifespan of the treated plywood (1). The lifespan can be, e.g., up to about 25 years, up to about 50 years, or up to about 100 years.

Specifically, the veneers (13) of wood can be contacted with the first resin (5) after the veneers (13) of wood are dried and before the stack of veneers (13) of wood are pressed.

Method(s) to Apply First Resin to Veneers

The first resin (5) can be applied to the veneers (13) in any suitable manner, provided: the first resin (5) effectively cures during the pressing of stack of veneers (13) (i.e., pressing stage); and the first resin (5) retains its adhesiveness over the extended periods of time typically encountered with the lifespan of the treated plywood (1). The lifespan can be, e.g., up to about 25 years, up to about 50 years, or up to about 100 years.

Suitable methods in which the veneers (13) can be contacted with the first resin (5) include, e.g., spraying, rolling, laminating, pressure injecting, dipping, curtain coating, foam application, and/or injecting the veneers (13) with the first resin (5). Specifically, the veneers (13) can be contacted with the first resin (5) by spraying the veneers (13) with the first resin (5).

Specifically, the veneers (13) of wood can be contacted with the first resin (5) by spraying the first resin (5) onto the veneers (13) of wood. More specifically, the veneers (13) of wood can be contacted with the first resin (5) by dry spraying the powdered first resin (5) onto the veneers (13) of wood.

Silicone-Containing Material

The silicone-containing material (6) will contact at least one outer surface of the treated wood-based product (1). Specifically, the silicone-containing material (6) will contact at least a portion of at least one outer surface of the treated wood-based product (1). Any suitable silicone-containing material (6) can be employed, provided:

the silicone-containing material (6) is relatively resistant to water without causing irreversible swelling of the flakes or veneers;

the silicone-containing material (6) maintains the requisite antifungal properties over the extended periods of time typically encountered with the lifespan of the treated wood-based product (1); and the resulting treated product is an effective fungal resistant wood-based product (1) over the extended periods of time typically encountered with the lifespan of the treated wood-based product (1). The lifespan can be, e.g., up to about 25 years, up to about 50 years, or up to about 100 years.

The silicone-containing material (6) can be employed in any suitable and appropriate amount. In one specific embodiment, the wood-based product is contacted with an amount of the silicone-containing material (6), such that at least one outer surface of the silicone-containing material (6) is completely contacted with the silicone-containing material (6).

When the silicone-containing material (6) is dissolved in a carrier, the silicone-containing material (6) can have any suitable concentration. For example, the silicone-containing material (6) can be employed in up to about 2.0 N, up to about 1.0 N, up to about 0.50 N, up to about 0.20 N, or up to about 0.10 N concentration in the carrier.

A suitable class of silicone-containing materials (6) include the compounds of formula (I):

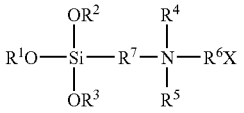

(I)

or a stereoisomeric form, a mixture of stereoisomeric forms, or an acceptable salt thereof, wherein $R^1$-$R^6$ are each independently selected from alkyl, substituted alkyl, cycloalkyl, substituted cycloalkyl, heterocycle, and substituted heterocycle;

$R^7$ is selected from alkylene and substituted alkylene; and X is F, Cl, Br, or I.

Regarding the compounds of formula (I):

A specific value for $R^1$ is alkyl. A more specific value for $R^1$ is methyl.

A specific value for $R^2$ is alkyl. A more specific value for $R^2$ is methyl.

A specific value for $R^3$ is alkyl. A more specific value for $R^3$ is methyl.

A specific value for $R^4$ is alkyl. A more specific value for $R^4$ is methyl.

A specific value for $R^5$ is alkyl. A more specific value for $R^5$ is methyl.

A specific value for $R^6$ is alkyl. A more specific value for $R^6$ is $C_{18}H_{37}$.

A specific value for $R^7$ is alkylene. A more specific value for $R^7$ is propylene ($C_3H_6$).

A specific value for X is Cl.

A specific suitable silicone-containing material (6) is 3-trimethoxy silyl propyl dimethyl octadecyl ammonium chloride, as shown below:

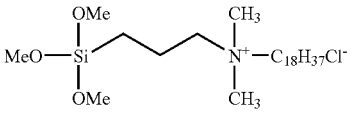

The silicone-containing material (6) can exist as a solid (e.g., powder), liquid, or oil. Additionally, the silicone-containing material (6) can be dissolved in an inert carrier. Suitable inert carriers include, e.g., water and/or alcohols such as methanol, ethanol, and propanol. When dissolved in an inert carrier, the silicone-containing material (6) can be stored and shipped under an inert atmosphere (e.g., nitrogen and/or argon), to lessen the likelihood that the silicone-containing material (6) will undergo decomposition or degradation.

The silicone-containing material (6) can optionally include a solubilizing agent, to assist the silicone-containing material (6) in dissolving in an inert carrier.

The silicone-containing material (6) can optionally include a catalyst, to assist the silicone-containing material (6) in adhering or cross-linking to the substrate (e.g., wood-based composite material).

The silicone-containing material (6) can optionally include a colorant, dye or indicator. The presence of such substances can readily indicate what portions of the substrate (e.g., wood-based composite material) have been treated with the silicone-containing material (6).

Compound Having a Dianion

Any suitable and appropriate compound having a dianion can be employed in the present invention. Specifically, the dianion can be selected from the group of sulphate ($SO_4^{2}$), carbonate ($CO_3^{2-}$), phosphate ($HPO_4^{2-}$), dichromate ($Cr_2O_7^{2-}$), chromate ($CrO_4^{2-}$), manganate (IV) or manganite ($MnO_3^{2-}$), permanganate ($MnO_4^{-}$), tungstate ($WO_4^{2-}$), oxalate ($C_2O_4^{2-}$), sulphite ($SO_3^{2-}$), thiosulphate ($S_2O_3^{2-}$), sulphide ($S^{2-}$), borate ($B_4O_7^{2-}$), silicate ($SiO_3^{2-}$) silicofluoride ($SiF_6^{2-}$), phosphite ($HPO_3^{2-}$), dithionite ($S_2O_4^{2-}$), tartrate ($C_4H_4O_6^{2-}$), succinate ($C_4H_4O_4^{2-}$), dithionite ($S_2O_4^{2-}$), molybdate ($MoO_4^{2-}$), platinate (IV) ($PtCl_6^{2-}$), selenite ($SeO_3^{2-}$), selenate ($SeO_4^{2-}$), tellurite ($TeO_3^{2-}$), tellurate ($TeO_3^{2-}$), diuranate ($U_2O_7^{2-}$) peroxodisulphate ($S_2O_8^{2-}$), thiotungstate ($WS_4^{2-}$), thiomolybdate $[MoS_4]^{2-}$, palladium (II) & palladium (IV) $[PdCl_4]^{2-}$ & $[PdCl_6]^{2-}$, plumbate (II) $(PbCl_4)_{2-}$ & $[Pb(CH3COO)_4]^{2-}$, hydroxoplumbate (II) $[Pb(OH)_4]^{2-}$, iodoplumbate (II) $[PbI_4]^{2-}$, stannate (II) $[Sn(OH)_4]^{2-}$, cyanocadmiate (II) $[Cd(CN)_4]^{2-}$, thiocyanatocobaltate (II) $[Co(SCN)_4]^{2-}$, cyanatocobaltate (II) $[Co(OCN)_4]^{2-}$, nickelate (II) $[Ni(CN)_4]^{2-}$, hydroxozincate (II) $[Zn(OH)_4]^{2-}$, thiocyanatomercurate (II) $[Hg(SCN)_4]^{2-}$, zerconate (IV) $[ZrF_6]^{2-}$, beryllate $[Be(OH)_4]^{2-}$, or cobaltate (II) $[Co(SCN)_4]^{2-}$.

Step(s) in which Silicone-Containing Material and/or Compound Having a Dianion can be Added to Flakes As disclosed in Tables III and IV and FIGS. 1-2, the flakes (12) of wood can be contacted independently with the silicone-containing material (6) and/or compound having a dianion at any suitable step to provide a treated oriented strand board (1), provided: the resin effectively cures during the pressing of the blanket of oriented flakes (12); and the resin retains its adhesiveness over the extended periods of time typically encountered with the lifespan of the treated oriented strand board (1); and the silicone-containing material (6) retains its antifungal properties over the extended periods of time typically encountered with the lifespan of the treated OSB (1). The lifespan can be, e.g., to about 10 years, up to about 25 years, up to about 50 years, or up to about 100 years).

Specifically, the flakes (12) of wood can be contacted independently with the silicone-containing material (6) and compound having a dianion after the flakes (12) of wood are pressed.

Specifically, as disclosed in Tables III and IV and FIGS. 1-2, the flakes (12) of wood can be contacted independently with the silicone-containing material (6) and compound having a dianion at a flaker outfeed, on a flake conveyor belt, at a drop-out to green bins (pantlegs), at an entry to green bins, on the inside of a green bins, at a green bin outfeed (drop chute), at a screw auger pan to dryer, at a airlock separation, at a dryer infeed, at a 1$^{st}$ pass of 3 pass dryer, at a dryer outfeed, at a primary cyclone, at an airlock separation, at a reversing conveyor to dry bin or fire dump or conveyor to screens, at an inside dry bins, at a dry bin conveyor, at a scales, on a conveyor, inside a blender, at a forming line heads, at a forming line, at a caul plate or screen, at a steam injection in press, or any combination thereof.

Specifically, as disclosed in Tables III and IV and FIGS. 1-2, the flakes (12) of wood can be independently contacted with the silicone-containing material (6) and compound having a dianion inside the blender.

Method(s) to Apply the Silicone-Containing Material and/or Compound Having a Dianion to Flakes The silicone-containing material (6) and compound having a dianion can be applied to the flakes (12) in any suitable manner, provided: the resin effectively cures during the pressing of oriented flakes (12) (i.e., pressing stage); and the resin retains its adhesiveness over the extended periods of time typically encountered with the lifespan of the treated oriented strand board (1); and the silicone-containing material (6) and compound having a dianion retains its antifungal properties over the extended periods of time typically encountered with the lifespan of the treated OSB (1). The lifespan can be, e.g., up to about 25 years, up to about 50 years, or up to about 100 years.

Specifically, Tables III-IV and FIGS. 1-2 illustrate suitable methods in which the flakes (12) can be independently contacted with the silicone-containing material (6) and/or compound having a dianion. These suitable methods include, e.g., spraying, rolling, laminating, pressure injecting, dipping, and/or injecting the flakes (12) with the silicone-containing material (6) and/or compound having a dianion. Specifically, the flakes (12) can be independently contacted with the silicone-containing material (6) and/or compound having a dianion by spraying the flakes (12) with the silicone-containing material (6) and/or compound having a dianion.

Specifically, the flake of wood can be independently contacted with the silicone-containing material (6) and/or compound having a dianion by spraying the silicone-containing material (6) and/or compound having a dianion onto the flakes (12) of wood. More specifically, the flake of wood can be independently contacted with the silicone-containing material (6) and/or compound having a dianion by dry spraying the powdered silicone-containing material (6) and/or compound having a dianion onto the flakes (12) of wood.

The following table illustrates possible locations and methods in which the silicone-containing material (6) and/or compound having a dianion can be introduced and applied to the flakes (12) of wood, wherein the locations are shown in the accompanying figures herein below.

TABLE III

| Id. | Materials Handling Process-Generic | Application Location | Comments |
|---|---|---|---|
| I. | Flaker to Convey system | Flaker Outfeed | |
| II. | Convey to Green Bins | Flake Conveyor belt | |
| III. | Convey to Green Bins | Drop-out to Green Bins (Pantlegs) | |
| IV. | Convey to Green Bins | Entry to Green Bins | |
| V. | Green Bin | Inside Green Bins | Head end before doffing rolls |
| VI. | Green Bin to Dryer | Green Bin Outfeed (drop chute) | |
| VII. | Green Bin to Dryer Airlock Separation | Screw auger pan to dryer Airlock Separation | Flakes are clumped and compressed |
| VIII. | Convey to Dryer | Dryer infeed | |
| IX. | Inside Dryer | 1$^{st}$ Pass of 3 pass dryer | Could also be inside conveyor dryer |
| X. | Convey to Product Separator (Primary Cyclone) | Dryer Outfeed | Nozzles in dryer outfeed |
| XI. | Product Separator Airlock Separation | Primary Cyclone Airlock Separation | |
| XII. | Convey to Screens and | Reversing Conveyor to | |

TABLE III-continued

| Id. | Materials Handling Process-Generic | Application Location | Comments |
|---|---|---|---|
| | Dry Bins | Dry Bin or Fire Dump or Conveyor to Screens | |
| XIII. | Dry Bin | Inside Dry Bins | Head end before doffing rolls |
| XIV. | Convey to scales Scales | Dry bin conveyor Scales | |
| XV. | Convey to Blender | On conveyor | Dry Chemical and/or Resin - Together or separately |
| XVI. | Blender | Inside Blender | Dry Chemical, Liquid Resin Liquid Chemical, Liquid Resin Dry Chemical, Dry Resin Liquid Chemical, Dry Resin |
| XVII. | Forming Heads | Forming Line Heads | Applying in forming head bins |
| XVIII. | Forming | Forming Line | Spray on dry flake mat |

The following table illustrates additional possible locations and methods in which the silicone-containing material (6) and/or compound having a dianion can be introduced and applied to the flakes (12) of wood. The locations are shown in the accompanying figures herein below.

TABLE IV

| Id. | Materials Handling Process-Generic | Application Location | Comments |
|---|---|---|---|
| XIX. | Convey | New Option: Pneumatic Conveyor | From Flaker to Green Bin - spray nozzles in pneumatic pipe |
| XX. | Green Flake Blender | Somewhere between 1 and 5, or at 6 and 7, or 8 | Could be off-line operation, or integrated into line |
| XXI. | Pre-dry (flake) Operation | After flaker, re-introduce to Green Bin or Dryer | Could be off-line operation or integrated into line |
| XXII. | Pre-Dry (flake) Operation | New Equip Options: Radio Frequency Microwave Rotary Dryer Conveyor Dryer Fluidized Bed Low Headspace Drying | |
| XXIII. | Pre-Dry or Dry | Conventional Line drying Options: Rotary Triple Pass Conveyor New Equipment: Single Pass Dryer Single Pass | |

TABLE IV-continued

| Id. | Materials Handling Process-Generic | Application Location | Comments |
|---|---|---|---|
| | | combination Blender/Dryer | |
| XXIV. | Pre-Compression | Pre-compression roller | |
| XXV. | Separate Operation | On Conventional OSB | Similar to conventional post-production treating Spray Spread Dip Pressure Treat (Retort) Pressure Inject Laminate |

The treated wood-based composite panel can be manufactured via a "hot press" method or a "cold press" method. As such, each of the components of the treated wood-based product (e.g., each of the adhesive(s), resin(s), silicone-containing material and compound having the dianion) can withstand the manufacturing conditions of any step involved in the manufacturing process of the treated wood-based product.

For example, the treated wood-based product can be manufactured via a "hot press" method, wherein the silicone-containing material (6) and/or the compound having the dianion can be contacted with the flakes or veneers just prior to the pressing stage. As such, the flakes or veneers can be pressed at an elevated temperature and at an elevated pressure to form a wood-based composite panel, while the silicone-containing material (6) and/or the compound having the dianion are present on at least a portion of at least one outer surface of the underlying treated wood-based product (1).

Additional suitable silicone-containing materials and compounds having dianions, as well as methods of preparing such antimicrobial formulations and methods of applying such antimicrobial formulations are disclosed in Published PCT Application WO 03/062345 A2.

All publications, patents, and patent documents cited herein are incorporated by reference herein, as though individually incorporated by reference. The invention has been described with reference to various specific and preferred embodiments and techniques. However, it should be understood that many variations and modifications may be made while remaining within the spirit and scope of the invention.

It is appreciated that certain features of the invention, which are, for clarity, described in the context of separate embodiments, may also be provided in combination in a single embodiment. Conversely, various features of the invention which are for brevity, described in the context of a single embodiment, may also be provided separately or in any sub-combination.

What is claimed is:

1. A process for manufacturing an antifungal wood-based composite panel, the process comprising:

(i) contacting, in any suitable order, flakes of wood with a first resin, an effective antifungal amount of a silicone containing material, and a compound having a dianion;

(ii) orienting, in substantially alternate lengthwise and crosswise layers, the flakes of wood to provide a blanket of substantially oriented flakes; and (iii) curing the first resin by exposing the first resin to at least one of an elevated temperature, an elevated pressure, and radiant energy; for a sufficient period of time; to effectively cure the first resin.

2. The process of claim 1 wherein the elevated temperature is about 162° C. (325° F.) to about 246° C. (475° F.).

3. The process of claim 1 wherein the elevated temperature is about 177° C. (350° F.) to about 232° C. (450° F.).

4. The process of claim 1 wherein the elevated temperature is about 191° C. (375° F.) to about 218° C. (425° F.).

5. The process of claim 1 wherein the elevated pressure is about 25 atm. (367 psi) to about 55 atm. (808 psi).

6. The process of claim 1 wherein the elevated pressure is about 30 atm. (441 psi) to about 50 atm. (735 psi).

7. The process of claim 1 wherein the elevated pressure is about 34 atm. (500 psi) to about 48 atm. (705 psi).

8. The process of claim 1 wherein the elevated pressure is about 35 atm. (514 psi) to about 45 atm. (661 psi).

9. The process of claim 1 wherein the sufficient period of time is up to about 10.0 minutes.

10. The process of claim 1 wherein the sufficient period of time is about 1.0 minute to about 12.0 minutes.

11. The process of claim 1 wherein the radiant energy is UV light.

12. The process of claim 1 wherein the radiant energy is electron beam.

13. The process of claim 1 wherein the radiant energy is neutron beam.

14. The process of claim 1 wherein the radiant energy is proton beam.

15. The process of claim 1 wherein the radiant energy is microwave.

16. The process of claim 1 wherein the radiant energy is beta radiation.

17. The process of claim 1 wherein the radiant energy is gamma radiation.

18. The process of claim 1 wherein the radiant energy is infra red.

19. The process of claim 1 wherein the radiant energy is radio frequency.

20. The process of claim 1 wherein the contacting of the wood-based product with the silicone containing material is carried out wherein the temperature of the wood-based composite panel is above about 25° C.

21. The process of claim 1 wherein the contacting of the wood-based product with the silicone containing material is carried out wherein the temperature of the wood-based product is above about 50° C.

22. The process of claim 1 wherein the contacting of the wood-based product with the silicone containing material is carried out wherein the temperature of the wood-based product is above about 70° C.

23. The process of claim 1 wherein the contacting of the wood-based product with the dianion is carried out wherein the temperature of the wood-based composite panel is above about 25° C.

24. The process of claim 1 wherein the contacting of the wood-based product with the dianion is carried out wherein the temperature of the wood-based product is above about 50° C.

25. The process of claim 1 wherein the contacting of the wood-based product with the dianion is carried out wherein the temperature of the wood-based product is above about 70° C.

26. The process of claim 1 wherein the contacting of the wood-based product with the dianion is carried out wherein the temperature of the wood-based product is about 150° C. to about 350° C.

27. The process of claim 1 wherein the contacting of the wood-based product with the dianion is carried out wherein the temperature of the wood-based product is about 200° C. to about 300° C.

28. The process of claim 1 wherein the silicone-containing material is N,N-dimethyl-N-octadecyl-3-(trimethoxysilyl) propanaminium chloride.

29. The process of claim 1 wherein the compound that includes the dianion is present in a solution having a concentration of up to about 3.0 Moles/Liter.

30. The process of claim 1 wherein the compound that includes the dianion is present in a solution having a concentration of up to about 1.0 Moles/Liter.

31. The process of claim 1 wherein the compound that includes the dianion is selected from the group of sodium carbonate, sodium biphosphate, sodium bicarbonate, magnesium sulphate, sodium oxalate, a hydrate thereof, or a combination thereof.

* * * * *